US009061491B2

(12) United States Patent
Otokita

(10) Patent No.: US 9,061,491 B2
(45) Date of Patent: Jun. 23, 2015

(54) LIQUID DISCHARGING APPARATUS AND CONTROLLING METHOD THEREFOR

(71) Applicant: Seiko Epson Corporation, Tokyo (JP)

(72) Inventor: Kenji Otokita, Yamagata (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/458,520

(22) Filed: Aug. 13, 2014

(65) Prior Publication Data

US 2015/0062219 A1 Mar. 5, 2015

(30) Foreign Application Priority Data

Aug. 30, 2013 (JP) ..... 2013-179899

(51) Int. Cl.
*B41J 29/38* (2006.01)
*B41J 2/045* (2006.01)

(52) U.S. Cl.
CPC ..... *B41J 2/04541* (2013.01); *B41J 2/04581* (2013.01)

(58) Field of Classification Search
CPC ..... B41J 2/04581; B41J 2/04588; B41J 2/04541; B41J 2/04591; B41J 2/04573
USPC ..... 347/9–11, 68
See application file for complete search history.

(56) References Cited

U.S. PATENT DOCUMENTS 6,431,675 B1 * 8/2002 Chang ..... 347/10
6,764,152 B2 * 7/2004 Umeda et al. ..... 347/9
6,840,595 B2 * 1/2005 Kusunoki ..... 347/10
7,150,513 B2 12/2006 Shinkawa et al.

FOREIGN PATENT DOCUMENTS

JP 2004-276544 A 10/2004

* cited by examiner

*Primary Examiner* — An Do
(74) *Attorney, Agent, or Firm* — Harness, Dickey & Pierce, P.L.C.

(57) ABSTRACT

A liquid discharging apparatus including: a nozzle which discharges a liquid; a pressure chamber which communicates with the nozzle; a piezoelectric element which is provided in order to discharge the liquid corresponding to the pressure chamber; a driving signal generation unit which generates a driving signal in order to drive the piezoelectric element; and a residual vibration detection unit which detects a residual vibration. The driving signal generation unit generates a driving signal for inspection which is a first electric potential during a first period, is a second electric potential during a second period, is a third electric potential during a third period, is shifted from the first electric potential to the second electric potential, and is shifted from the second electric potential to the third electric potential. The third electric potential is an electric potential between the first electric potential and the second electric potential.

8 Claims, 17 Drawing Sheets

EXPERIMENTAL VALUE AND CALCULATED VALUE OF RESIDUAL VIBRATION (IN CASE OF NORMAL OPERATION)

EXPERIMENTAL VALUE AND CALCULATED VALUE OF RESIDUAL VIBRATION (AIR BUBBLE)

EXPERIMENTAL VALUE AND CALCULATED VALUE OF RESIDUAL VIBRATION (DRIED)

EXPERIMENTAL VALUE AND CALCULATED VALUE OF RESIDUAL VIBRATION (PAPER POWDER)

| SI (b1, b2, b3) | Tc1 | | | Tc2 | | |
|---|---|---|---|---|---|---|
| | Sa | Sb | Sc | Sa | Sb | Sc |
| (1, 1, 0) | H | L | L | H | L | L |
| (1, 0, 0) | H | L | L | L | H | L |
| (0, 1, 0) | L | H | L | H | L | L |
| (0, 0, 0) | L | H | L | L | H | L |
| (0 OR 1, 0 OR 1, 1) | L | L | H | L | L | H |

| Flag | NTc (COMPARISON CONTENT) | Rs |
|---|---|---|
| 1 | NTc < NTx1 | 2: DISCHARGE ABNORMALITY (AIR BUBBLE) |
| | NTx1 ≤ NTc ≤ NTx2 | 1: NORMAL |
| | NTx2 < NTc ≤ NTx3 | 3: DISCHARGE ABNORMALITY (PAPER POWDER) |
| | NTx3 < NTc | 4: DISCHARGE ABNORMALITY (THICKENED) |
| 0 | N/A | 5: DISCHARGE ABNORMALITY |

LIQUID DISCHARGING APPARATUS AND CONTROLLING METHOD THEREFOR

BACKGROUND

1. Technical Field

The present invention relates to a liquid discharging apparatus and a controlling method therefor.

2. Related Art

An ink jet type printer performs printing by discharging ink inside a cavity. When the ink dries, the ink is thickened. When the ink inside the cavity is thickened, a discharge failure is caused. In addition, when air bubbles are included in the ink inside the cavity, or when paper powder is attached to a nozzle that discharges the ink, discharge failure is caused. Accordingly, it is preferable to inspect a discharge state of the ink.

In JP-A-2004-276544, a vibration is given to the ink inside the cavity by using a piezoelectric element, and a behavior of the ink is detected with respect to a residual vibration thereof. Accordingly, a technique is disclosed that determines the discharge state.

Meanwhile, in a case where the discharge state of the ink is inspected during printing, if the ink is discharged by the vibration given to the piezoelectric element, a recording medium is stained. Furthermore, ink is consumed. For this reason, it is preferable to drive the piezoelectric element such that the ink is not discharged during the inspection. In order to drive the piezoelectric element such that the ink is not discharged, an inspection pulse having a small amplitude may be applied to the piezoelectric element.

However, there is a problem that an excitation force given to the ink is small and the residual vibration cannot be accurately detected with the inspection pulse having a small amplitude.

SUMMARY

An advantage of some aspects of the invention is to detect the residual vibration more precisely without discharging a liquid, such as ink.

According to an aspect of the invention, there is provided a liquid discharging apparatus including: a nozzle which discharges a liquid; a pressure chamber which communicates with the nozzle; a piezoelectric element which is provided in order to discharge the liquid corresponding to the pressure chamber; a driving signal generation unit which generates a driving signal in order to drive the piezoelectric element; and a residual vibration detection unit which detects a change in an electromotive force of the piezoelectric element according to a residual vibration generated after applying the driving signal in the pressure chamber. The driving signal generation unit generates a driving signal for inspection which is a first electric potential during a first period, is a second electric potential during a second period, is a third electric potential during a third period, is shifted from the first electric potential to the second electric potential, and is shifted from the second electric potential to the third electric potential. The third electric potential is an electric potential between the first electric potential and the second electric potential.

According to the aspect of the invention, the driving signal for inspection is shifted from the first electric potential to the second electric potential, and further changes from the second electric potential to the third electric potential which is an electric potential between the first electric potential and the second electric potential. Accordingly, during the process of shifting from the first electric potential to the second electric potential, it is possible to apply a large excitation force to the liquid. Further, as the second electric potential is changed to the third electric potential and the third electric potential is maintained, it is possible to keep using the excitation force and to control an internal pressure of the pressure chamber such that the liquid is not discharged from the nozzle. Accordingly, it is possible to obtain a large residual vibration without discharging the liquid from the nozzle.

In addition, since the excitation force is specified according to a potential difference between the first electric potential and the second electric potential, the second electric potential with respect to the first electric potential may be a high electric potential or may be a low electric potential. In addition, the first electric potential may be an electric potential which is maintained in the piezoelectric element when the liquid is not discharged. Furthermore, the first electric potential may be the maximum electric potential or the minimum electric potential of the electric potential obtained as the driving signal.

According to the aspect of the above-described liquid discharging apparatus, in the driving signal for inspection, when a time from an end of the first period to an end of the second period is set to Txa, and when a natural vibration cycle of the pressure chamber is set to Tc, it is preferable that $Tc/2-Tc/4<Txa<Tc/2+Tc/4$. According to the aspect, since it is possible to specify the time from the end of the first period to the end of the second period in order to strengthen the vibration of the liquid in the pressure chamber, an amplitude of the driving signal for inspection can be efficiently used.

According to the aspect of the above-described liquid discharging apparatus, during a period from the end of the first period to a start of the second period, it is preferable that the driving signal generation unit be provided with a fourth period which maintains a fourth electric potential, shift the driving signal for the inspection from the first electric potential to the fourth electric potential, and shift the driving signal for the inspection from the fourth electric potential to the second electric potential. It is preferable that potential difference between the fourth electric potential and the second electric potential be larger than potential difference between the first electric potential and the second electric potential.

According to the aspect, since the potential difference between the fourth electric potential and the second electric potential is larger than the potential difference between the first electric potential and the second electric potential, it is possible to apply a larger excitation force to the liquid inside the pressure chamber, compared with a case where the first electric potential is directly shifted to the second electric potential. Accordingly, it is possible to generate a large residual vibration by efficiently using a dynamic range of the driving signal. In addition, since the excitation force is specified according to the potential difference between the fourth electric potential and the second electric potential, the second electric potential with respect to the fourth electric potential may be a high electric potential and may be a low electric potential.

According to the aspect of the above-described liquid discharging apparatus, in the driving signal for inspection, when a time from an end of the fourth period to the end of the second period is set to Txb, and when the natural vibration cycle of the pressure chamber is set to Tc, it is preferable that $Tc/2-Tc/4<Txb<Tc/2+Tc/4$. According to the aspect, it is possible to specify the time from the end of the fourth period to the end of the second period in order to strengthen the vibration of the liquid in the pressure chamber. Therefore, the amplitude of the driving signal for inspection can be efficiently used.

According to the aspect of the above-described liquid discharging apparatus, it is preferable that the driving signal generation unit generate the driving signal for inspection so that the third period is longer than the second period. According to the aspect, it is possible to allocate a period for detecting the residual vibration to be longer than the second period.

According to the aspect of the above-described liquid discharging apparatus, it is preferable that the driving signal generation unit generate the driving signal for inspection so that the third period is longer than a natural vibration cycle of the pressure chamber. According to the aspect, it is possible to ascertain the natural vibration cycle of the pressure chamber by detecting the residual vibration during the third period.

According to the aspect of the above-described liquid discharging apparatus, when a time from a start of the third period to an end of the third period is set to T3, when a natural vibration cycle of the pressure chamber is set to Tc, and when k is set to a natural number, it is preferable that $k \cdot Tc - Tc/4 < T3 < k \cdot Tc + Tc/4$. According to the aspect, since it is possible to suppress the residual vibration to be removed at the end of the third period, it is possible to reduce an effect of the residual vibration on following operations, such as printing after the end of the inspection.

According to another aspect of the invention, there is provided a controlling method for the liquid discharging apparatus including a nozzle which discharges a liquid, a pressure chamber which communicates with the nozzle, and a piezoelectric element which is provided in order to discharge the liquid corresponding to the pressure chamber. The controlling method for the liquid discharging apparatus including: applying a driving signal for inspection to the piezoelectric element; detecting a change in the electromotive force of the piezoelectric element according to the residual vibration generated after applying the driving signal for inspection in the pressure chamber; and determining a discharge state of the liquid according to the detection result. The driving signal for inspection is a first electric potential during a first period, is a second electric potential during a second period, is a third electric potential during a third period, is shifted from the first electric potential to the second electric potential, and is shifted from the second electric potential to the third electric potential. The third electric potential is an electric potential between the first electric potential and the second electric potential.

According to the aspect of the controlling method for liquid discharging apparatus, it is possible to apply a large excitation force to the liquid during the process of shifting from the first electric potential to the second electric potential. Furthermore, it is possible to use the excitation force and control the internal pressure of the pressure chamber such that the liquid is not discharged from the nozzle by shifting the second electric potential to the third electric potential and maintaining the third electric potential. Accordingly, it is possible to obtain a large residual vibration without discharging the liquid from the nozzle.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to drawings. However, in each drawing, dimensions and a scale of each unit are made appropriately different from a real size. In addition, since the embodiments described below are appropriate specific examples of the invention, there are various limits which are technically preferable. However, a range of the invention is not limited to the embodiments unless an idea which limits the scope of the invention is specifically mentioned in the invention.

A. Embodiment

In the embodiment, a line printer of an ink jet type which forms an image on recording paper P (an example of a "recording medium") by discharging ink (an example of a "liquid") is described as an example of a printing apparatus.

Figure 1:
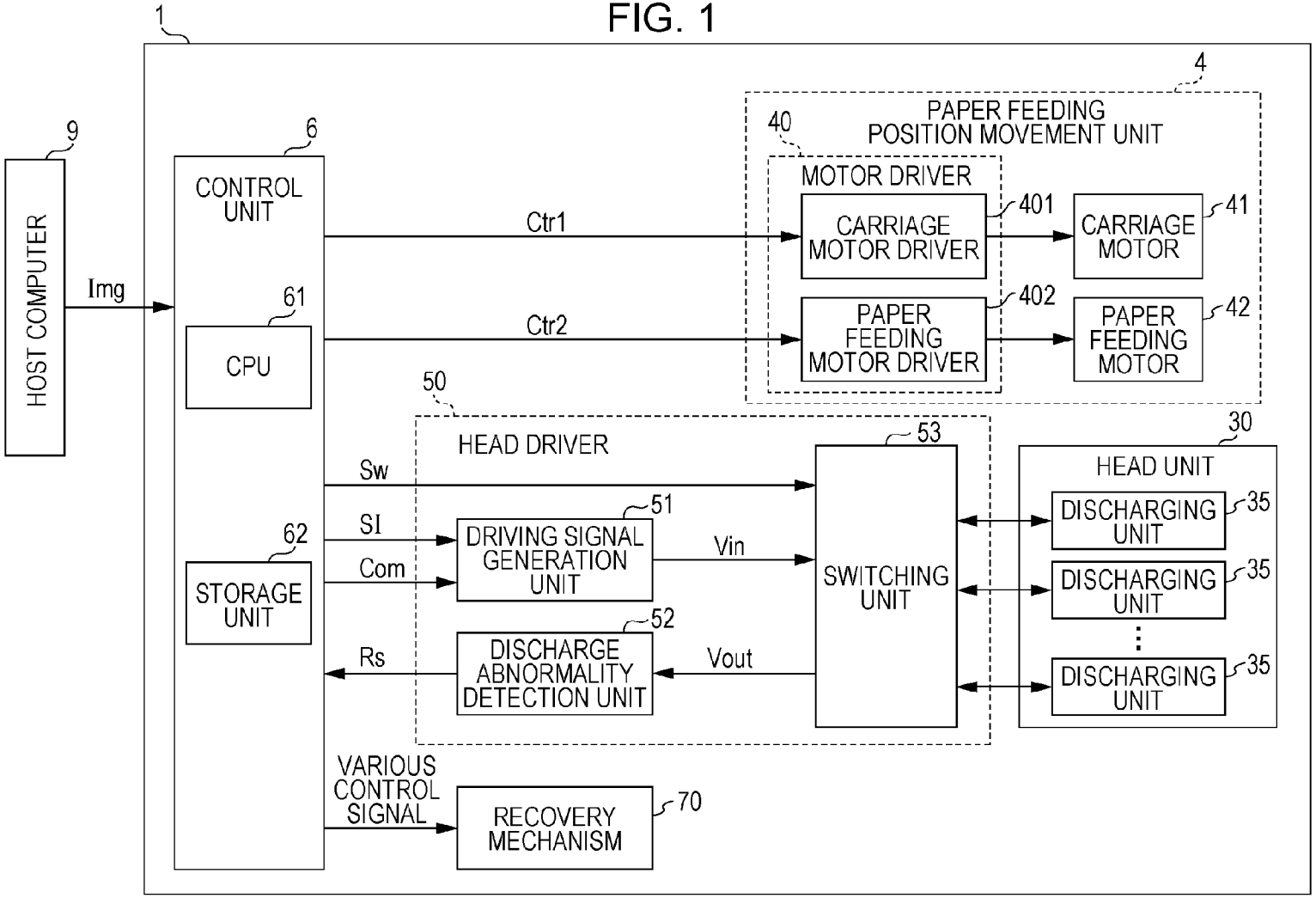
FIG. 1 is a block diagram illustrating a configuration of an ink jet printer according to an embodiment of the invention.

FIG. 1 is a functional block diagram illustrating a configuration of an ink jet printer 1 according to the embodiment. As illustrated in FIG. 1, the ink jet printer 1 includes: a head unit 30 which has M (M is a natural number equal to or higher than 2) discharging units 35 which can discharge the ink filling the inside thereof; a head driver 50 which drives the head unit 30; a paper feeding position movement unit 4 (an example of a "relative position movement unit") for moving a relative position of the head unit 30 with respect to the recording paper P; and a recovery mechanism 70 which performs a recovery process of recovering a discharge state of the discharging unit 35 to a normal state in a case where a discharge abnormality is detected in the discharging unit 35.

In addition, based on image data Img supplied from a host computer 9, such as a personal computer, a digital camera or the like, due to controlling operations of the paper feeding position movement unit 4, the head driver 50, and the recovery mechanism 70, the ink jet printer 1 includes a control unit 6 that controls performance of various processes such as a printing process of forming an image on the recording paper P, a discharge abnormality detection process of detecting the discharge abnormality of the discharging unit 35, the recovery process of recovering the discharge state of the discharging unit 35 to the normal state, or the like.

The control unit 6 is provided with a CPU 61 and a recording unit 62. The recording unit 62 is provided with an Electrically Erasable Programmable Read-Only Memory (EEPROM) which is a type of a nonvolatile semiconductor memory that stores the image data Img in a data storage region. The image data Img is supplied from the host computer 9 via an interface unit (not illustrated). The recording unit 62 is provided with a Random Access Memory (RAM) which temporarily stores data, such as shape information of the recording paper P, required when the printing process is performed and discharge abnormality detection result data representing a result obtained by the discharge abnormality detection process, or which temporarily develops a control program for performing various processes, such as the printing process or the like to proceed. The recording unit 62 is provided with a PROM which is a type of nonvolatile semiconductor memory which stores a control program or the like which controls each unit of the ink jet printer 1.

The CPU 61 controls performance of various processes, such as the printing process, the discharge abnormality detection process, the recovery process, or the like. More specifically, the CPU 61 stores the image data Img supplied from the host computer 9 in the recording unit 62. In addition, based on various data, such as the image data Img, stored in the recording unit 62, the CPU 61 generates driver control signals Ctr1 and Ctr2 for controlling driving of the paper feeding position movement unit 4, a printing signal SI for controlling driving of the head driver 50, a switching control signal Sw, various signals such as a driving waveform signal Com, and various control signals for controlling driving of the recovery mechanism 70. The CPU 61 supplies the generated signals to each unit of the ink jet printer 1. Accordingly, the CPU 61 controls the operations of the paper feeding position movement unit 4, the head driver 50, and the recovery mechanism 70, and controls performance of various processes, such as the printing process, the discharge abnormality detection process, and the recovery process. In addition, each configuration element of the control unit 6 is electrically connected via a bus (not illustrated).

The head driver 50 is provided with a driving signal generation unit 51, a discharge abnormality detection unit 52, and a switching unit 53.

Based on the printing signal SI and the driving waveform signal Com supplied from the control unit 6, the driving signal generation unit 51 generates a driving signal Vin for driving the discharging unit 35 provided in the head unit 30. The driving waveform signal Com will be described below in detail. The driving waveform signal Com in the embodiment includes three driving waveform signals Com-A, Com-B, and Com-C.

In addition, the printing signal SI and the driving waveform signal Com are referred to as a "printing control signal". In other words, the driving signal generation unit generates the driving signal Vin based on the printing control signals.

The discharge abnormality detection unit 52 detects a pressure change in the discharging unit 35 generated after the discharging unit 35 is driven by the driving signal Vin and caused by a vibration of the ink or the like in the discharging unit 35 as a residual vibration signal Vout. At the same time, based on the residual vibration signal Vout, the discharge abnormality detection unit 52 determines whether or not the discharge abnormality exists in the discharging unit 35, determines the discharge state of the ink in the discharging unit 35, and outputs the determination result as a determination result signal Rs.

Based on the switching control signal Sw supplied from the control unit 6, the switching unit 53 brings each discharging unit 35 into contact with any one of the driving signal generation unit 51 or the discharge abnormality detection unit 52.

The paper feeding position movement unit 4 has a carriage motor 41 for moving the head unit 30 (more specifically, for moving a carriage 32 on which the head unit 30 is mounted), a carriage motor driver 401 for driving the carriage motor 41, a paper feeding motor 42 for transporting the recording paper P, and a paper feeding motor driver 402 for driving the paper feeding motor 42. In addition, the carriage motor driver 401 and the paper feeding motor driver 402 are referred to as a motor driver 40.

Figure 2:
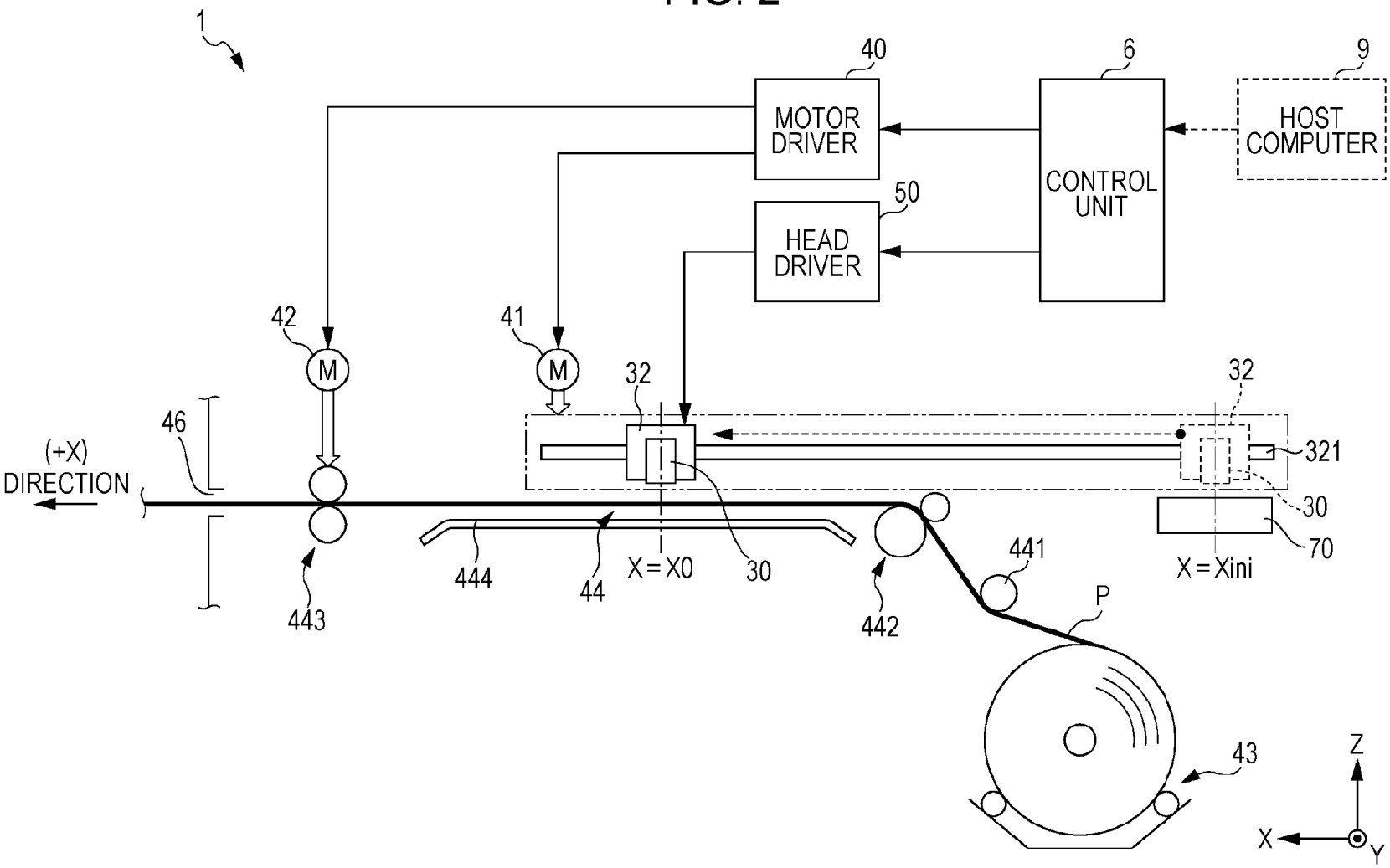
FIG. 2 is a view illustrating a schematic configuration of the ink jet printer.

FIG. 2 is a schematic view illustrating a configuration of the ink jet printer 1. As illustrated in FIG. 2, the ink jet printer 1 includes a roll paper storage unit 43 for storing roll paper with a configuration in which the recording paper P is rolled in a roll shape, and delivers the recording paper P from the roll paper storage unit 43. The recording paper P is transported by a pair of driving-side paper sending rollers 443 which are rotatably driven by the paper feeding motor 42, in an X-axis direction along a transporting path 44 defined by a guide roller 441, a pair of driven-side paper sending rollers 442, the pair of the driving-side paper sending rollers 443, a platen 444, and the like, and is taken out of a paper outlet 46.

The carriage 32 on which the head unit 30 is mounted is disposed on a side opposite to the platen 444 which has the transporting path 44 of the recording paper P inbetween, that is, in a +Z direction when viewed from the platen 444. The carriage 32 can perform a linear reciprocative movement within a predetermined range along the X-axis direction through a head unit movement mechanism including a carriage guide axis 321 which has, for example, a ball screw and a ball spline that extend in the X-axis direction and a carriage motor 41.

In a state where the head unit 30 is moved to the printing position (X=X0), the control unit 6 transports the recording paper P in the X-axis direction, discharges the ink based on the image data Img in a region where a label Lb is disposed on the recording paper P from a plurality of discharging units 35 provided in the head unit 30, thereby performing the printing process.

In addition, in a case where the discharge abnormality of the discharging unit 35 is discovered, the control unit 6 moves the head unit 30 to an initial position (X=Xini) facing the recovery mechanism 70, thereby performing the recovery process.

In addition, the ink jet printer 1 includes four ink cartridges (not illustrated in FIG. 2) which are full of ink. Specifically, the four ink cartridges are provided in accordance with four colors, such as yellow, cyan, magenta, and black, of the ink one in each. The four cartridges are mounted on the carriage 32.

Each of M discharging units 35 receives the ink supplied from any one of the four ink cartridges. Accordingly, it is possible to discharge any one of the four colors of the ink from each discharging unit 35, thereby performing full-color printing.

In addition, instead of being mounted on the carriage 32, the ink cartridge may be installed in a different place on the ink jet printer 1. The ink jet printer 1 may further include an ink cartridge which is full of ink having a color other than the above-described four colors, and may have an ink cartridge which corresponds to only one color among the above-described four colors (for example, the ink jet printer 1 may have only one ink cartridge which corresponds to black).

Figure 3:
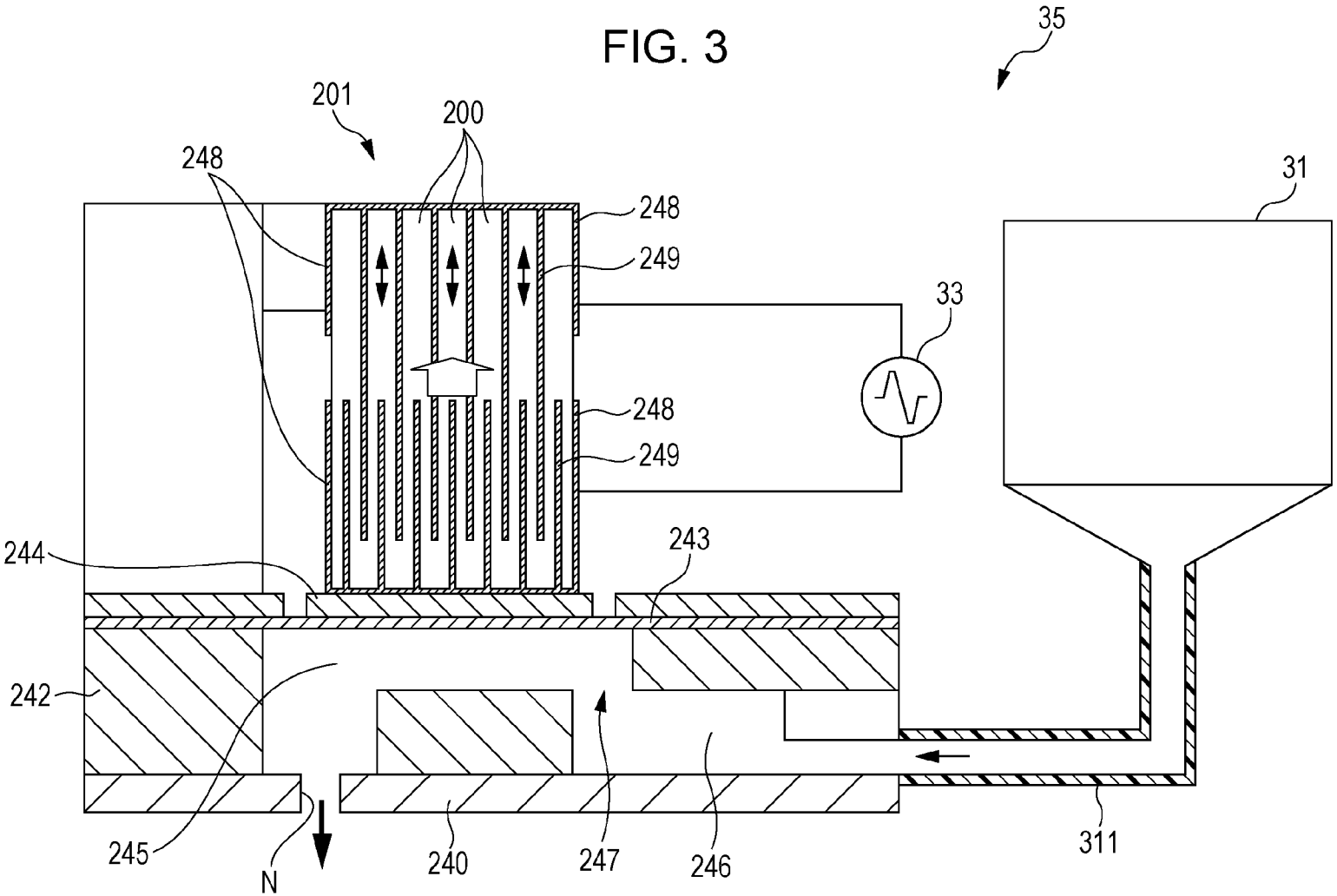
FIG. 3 is a schematic cross-sectional view illustrating an example of a head unit according to the embodiment.

In addition, as illustrated in FIG. 3, the head unit 30 has a width equal to or wider than a width in a Y-axis direction of the recording paper P in a planar view. As described above, the head unit 30 has M discharging units 35. Each of the M discharging units 35 has one nozzle N, respectively. In other words, in the head unit 30, M nozzles N (N[1], N[2], . . . , N[M]) are provided.

The head unit 30 illustrated as an example in the drawing has four nozzle rows which have a plurality of nozzles N (22 nozzles N in the drawing) that extends in a horizontal direction (Y-axis direction). Among the four nozzle rows, yellow (Y) ink is discharged from each nozzle N included in a first nozzle row. Magenta (M) ink is discharged from each nozzle N included in a second nozzle row. Cyan (C) ink is discharged from each nozzle N included in a third nozzle row. Black (K) ink is discharged from each nozzle N included in a fourth nozzle row.

Next, referring to FIGS. 3 and 4, a configuration of the head unit 30 and the discharging unit 35 provided in the head unit 30 will be described.

FIG. 3 is a schematic cross-sectional view of each discharging unit 35 provided in the head unit 30. The discharging unit 35 illustrated in FIG. 3 discharges ink (liquid) in the cavity 245 from the nozzle N by driving the piezoelectric element 200. The discharging unit 35 has a nozzle plate 240 on which the nozzle N is formed, a cavity plate 242, a vibration plate 243, and a laminated piezoelectric element 201 on which a plurality of piezoelectric elements 200 are laminated.

The cavity plate 242 is formed in a predetermined shape (shape in which a recessed portion is formed). Accordingly, the cavity 245 and a reservoir 246 are formed. The cavity 245 and the reservoir 246 communicate with each other via an ink supply port 247. In addition, the reservoir 246 communicates with the ink cartridge via an ink supply tube 311.

The lower end of the laminated piezoelectric element 201 in FIG. 3 is joined with the vibration plate 243 via a intermediate layer 244. On the laminated piezoelectric element 201, a plurality of external electrodes 248 and internal electrodes 249 are connected with each other. In other words, the external electrodes 248 are connected to an outer surface of the laminated piezoelectric element 201, and the internal electrodes 249 are installed between each of the piezoelectric elements 200 (or inside each piezoelectric element) that constitutes the laminated piezoelectric element 201. In this case, a part of the external electrode 248 and the internal electrode 249 are alternately disposed to be overlapped in a width direction of the piezoelectric element 200.

By applying a driving voltage waveform from the driving signal generation unit 33 to between the external electrode 248 and the internal electrode 249, the laminated piezoelectric element 201 is deformed as illustrated by an arrow in FIG. 3 (extended and contracted in a vertical direction of FIG. 3) and vibrated. According to the vibration, the vibration plate 243 is vibrated. According to the vibration of the vibration plate 243, the volume (pressure inside the cavity) of the cavity 245 is changed, and the ink (liquid) which fills the cavity 245 is discharged from the nozzle N as the liquid.

The decreased liquid volume inside the cavity 245 due to the discharge of the liquid is replenished with ink supplied from the reservoir 246. In addition, the ink is supplied to the reservoir 246 from the ink cartridge via the ink supply tube 311.

Figure 4:
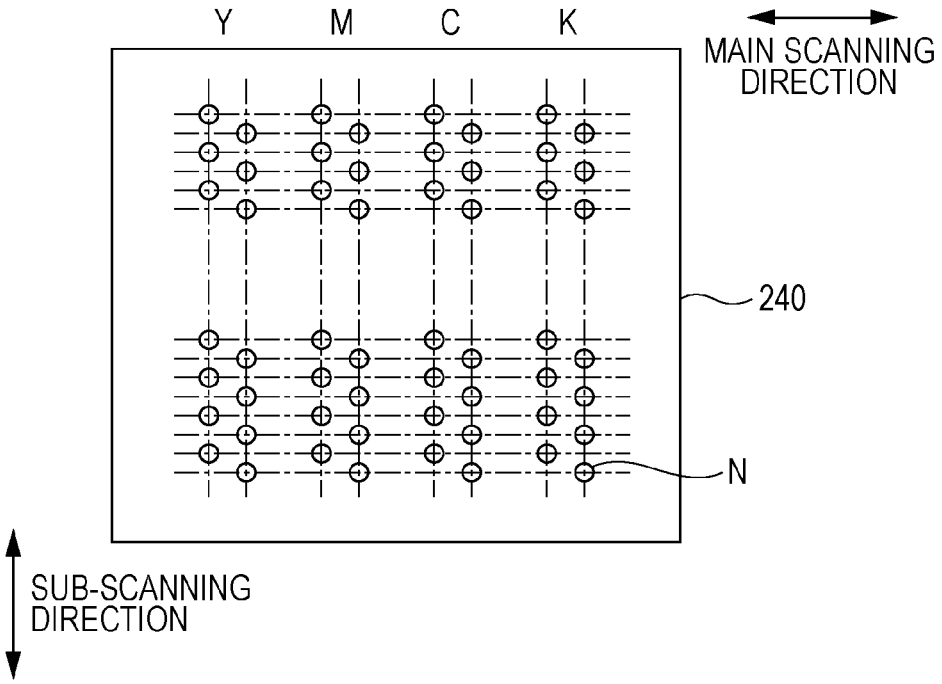
FIG. 4 is a plan view illustrating an arrangement pattern of a nozzle.
Figure 5:
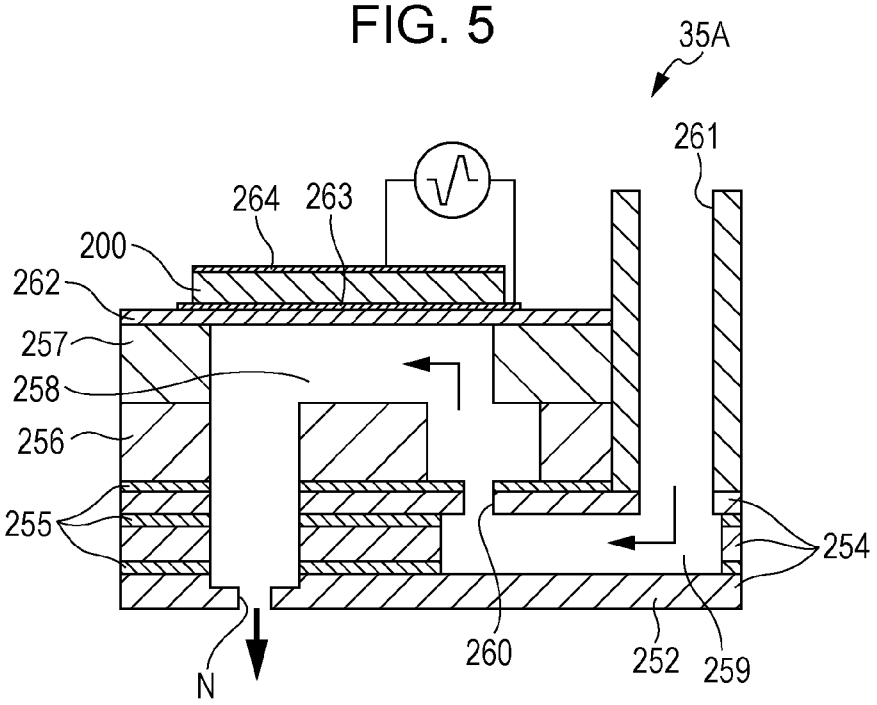
FIG. 5 is a schematic cross-sectional view illustrating a configuration which illustrates another example of the head unit.

In addition, the arrangement pattern of the nozzles N formed on the nozzle plate 240 illustrated in FIG. 3 is, for example, disposed so as to be shifted by one column as in the nozzle arrangement pattern illustrated in FIG. 4. In addition, a pitch between the nozzles 110 is obtained by appropriate setting according to a print resolution (dpi: dots per inch). FIG. 5 illustrates the arrangement pattern of the nozzles N in a case where the four colors of ink (ink cartridge) are adopted.

Next, another example of the discharging unit 35 will be described. In a discharging unit 35A illustrated in FIG. 5, a vibration plate 262 is vibrated due to the vibration of the piezoelectric element 200, and the ink (liquid) in a cavity 258 is discharged from the nozzle N. A metal plate 254 made of stainless steel is connected to a nozzle plate 252 which is made of stainless steel and in which a nozzle (hole) 253 is formed, via an adhesive film 255. Further, to the top thereof, a similar metal plate 254 made of stainless steel is connected via the adhesive film 255. To the top thereof, a communication opening forming plate 256 and a cavity plate 257 are connected in order.

The nozzle plate 252, the metal plate 254, the adhesive film 255, the communication opening forming plate 256, and the cavity plate 257 are molded into a predetermined shape (a shape in which a recessed portion is formed), respectively. By stacking these, the cavity 258 and a reservoir 259 are formed. The cavity 258 and the reservoir 259 communicate with each other via an ink supply port 260. In addition, the reservoir 259 communicates with an ink introducing port 261.

On an opening part of an upper surface of the cavity plate 257, the vibration plate 262 is installed. The piezoelectric element 200 is connected to the vibration plate 262 via a lower part electrode 263. In addition, an upper part electrode 264 is connected to the side opposite to the lower part electrode 263 of the piezoelectric element 200. In the driving signal generation unit 33, by applying (supplying) the driving voltage waveform to between the upper part electrode 264 and the lower part electrode 263, the piezoelectric element 200 is vibrated, and the vibration plate 262 which is connected thereto is vibrated. According to the vibration of the vibration plate 262, the volume (pressure inside the cavity) of the cavity 258 is changed, and the ink (liquid) which fills the cavity 258 is discharged from the nozzle N as the liquid.

The decreased liquid volume inside the cavity 258 due to the discharge of the liquid is replenished with the ink supplied from the reservoir 259. In addition, the ink is supplied to the reservoir 259 from the ink introducing port 261.

Figure 6A:
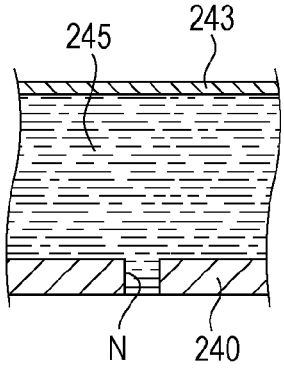
FIGS. 6A to 6C are views for describing a change of a cross-sectional shape of the head unit when a driving signal is supplied.
Figure 6B:
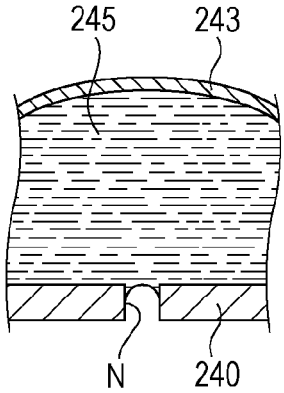
Figure 6C:
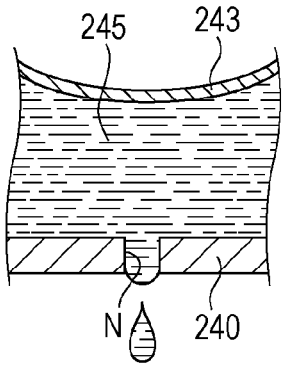

Next, a discharge of ink droplets will be described with reference to FIGS. 6A to 6C. When the driving voltage is applied from the driving signal generation unit 33 to the piezoelectric element 200 illustrated in FIG. 3 (FIG. 5), a Coulomb force between the electrodes is generated. The vibration plate 243 (262) bends from the initial state illustrated in FIG. 6A in an upward direction of FIG. 3 (FIG. 5), and the volume of the cavity 245 (258) expands as illustrated in FIG. 6B. In this state, when the driving voltage is changed by controlling the driving signal generation unit 33, the vibration plate 243 (262) is restored according to an elastic restoring force thereof and moves further downward than the position of the vibration plate 243 (262) in the initial state. Accordingly, the volume of the cavity 245 (258) contracts drastically as illustrated in FIG. 6C. According to a compression pressure generated inside the cavity 245 (258) at this moment, a part of the ink (liquid material) which fills the cavity 245 (258) is discharged as the ink droplets from the nozzle N which communicates with the cavity 245 (258).

After a series of ink discharging operations is completed, the vibration plate 243 of each cavity 245 performs a damps oscillation until starting the next ink discharging operation. Hereinafter, the damps oscillation is referred to as residual vibration. It is assumed that the residual vibration of the vibration plate 243 has a natural vibration frequency determined by an acoustic resistance r due to a shape of the nozzle N or the ink supply port 247, an ink viscosity, or the like, an inertance m due to an ink weight inside a flow path, and a compliance Cm of the vibration plate 243.

A calculation model of the residual vibration of the vibration plate 243 based on the above-described assumptions will be described.

Figure 7:
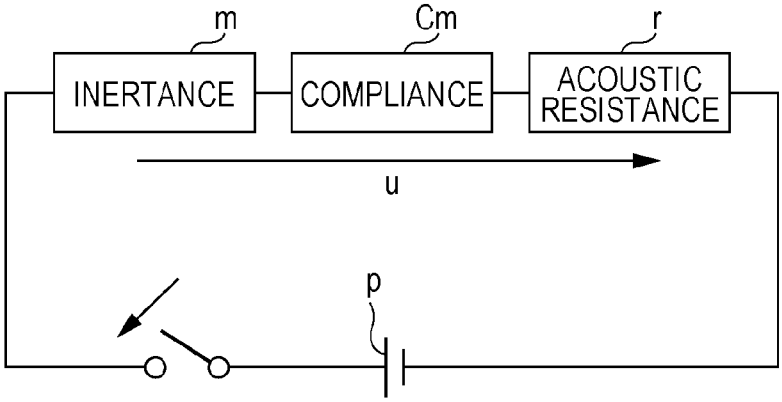
FIG. 7 is a circuit diagram illustrating a model of a simple harmonic oscillation which represents a residual vibration in a discharging unit.

FIG. 7 is a circuit diagram showing the calculation model of the simple harmonic oscillation which assumes the residual vibration of the vibration plate 243. As illustrated in the drawing, the calculation model of the residual vibration of the vibration plate 243 represents a sound pressure p, the above-described inertance m, the compliance Cm, and the acoustic resistance r. If a step response at a time when the sound pressure p is applied to the circuit of FIG. 7 is calculated with respect to a volume velocity u, the following expression is obtained.

$$u=\{p/(\omega\cdot m)\}e^{-\omega t}\cdot\sin(\omega t)$$

$$\omega=\{1/(m\cdot Cm)-\alpha^2\}^{1/2}$$

$$\alpha=r/(2m)$$

Figure 8:
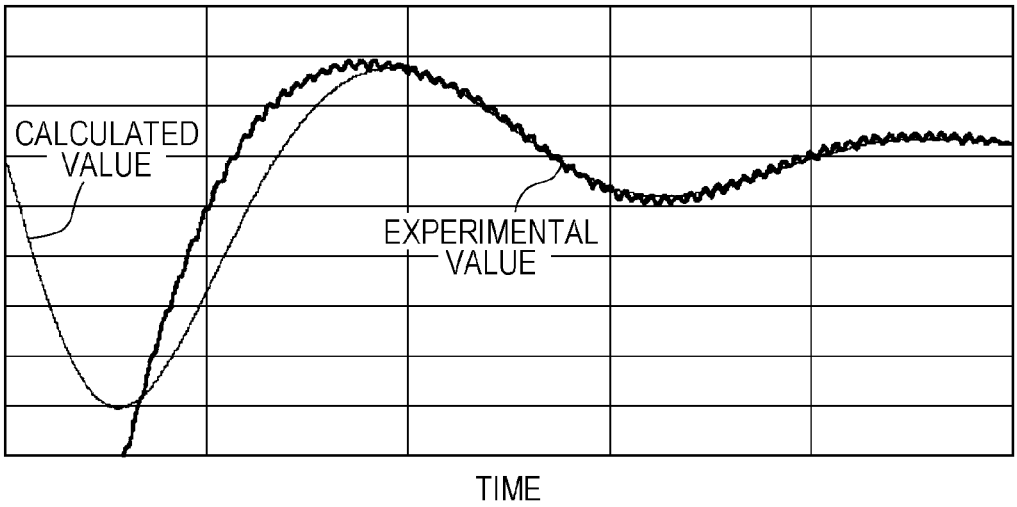
FIG. 8 is a graph illustrating a relationship between an experimental value and a calculated value of the residual vibration in a case where a discharge state is normal in the discharging unit.

A calculation result obtained from the expression and an experimental result from an additionally performed experiment of the residual vibration of the vibration plate 243 after the ink droplets are discharged are compared with each other. FIG. 8 is a graph illustrating a relationship between the experimental value and the calculated value of the residual vibration of the vibration plate 243. As seen from the graph illustrated in FIG. 8, two waveforms of the experimental value and the calculated value almost match each other.

In the discharging unit 35, there is a phenomenon where the ink droplets are not discharged normally from the nozzle N even though the above-described discharging operation is performed, that is a case where a discharge abnormality of the liquid is generated. Reasons for generation of the discharge abnormality include (1) incorporated air bubbles in the cavity 245, (2) dried and thickened (fixed) ink in the vicinity of the nozzle N, (3) adhered paper powder in the vicinity of an outlet of the nozzle N, or the like.

When such a discharge abnormality is generated, as a result thereof, typically, the liquid is not discharged from the nozzle N, that is, a non-discharge phenomenon of the liquid appears. In this case, a dot omission of a pixel in an image printed on the recording paper P occurs. In addition, in a case of the discharge abnormality, even when the liquid is discharged from the nozzle N, the liquid may not appropriately reach the recording paper because the volume of the liquid is too little or because a flying direction (trajectory) of the liquid is shifted. Accordingly, the dot omission of the pixel appears after all. As a result, in the following description, there is a case where the discharge abnormality of the liquid is simply referred to as "dot omission."

Hereinafter, based on a comparison result illustrated in FIG. 8, according to each reason for the phenomenon (liquid non-discharge phenomenon) of the dot omission (discharge abnormality) during a printing process generated in the discharging unit 35, at least one value between the acoustic resistance r and the inertance m is adjusted so that the calculated value and the experimental value of the residual vibration of the vibration plate 243 match (almost match) each other.

Figure 9:
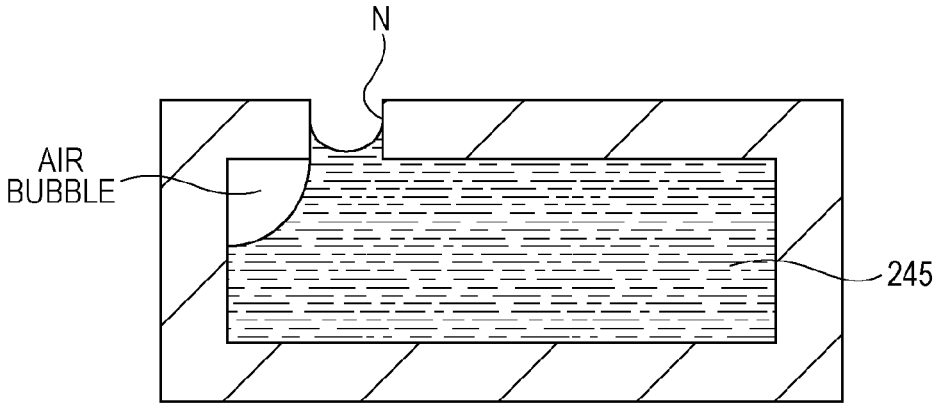
FIG. 9 is a view illustrating a state of the discharging unit in a case where air bubbles are incorporated in a cavity.

First, here is one of the reasons for the dot omission. (1) The incorporated air bubbles in the cavity 245 are inspected. FIG. 9 is a schematic view of the vicinity of the nozzle N in a case where the air bubbles are incorporated in the cavity 245. As illustrated in FIG. 9, it is assumed that the generated air bubbles adhere to a wall surface of the cavity 245.

In this manner, in a case where the air bubbles are incorporated in the cavity 245, the total weight of the ink which fills the cavity 245 is reduced and the inertance m is considered to be lowered. In addition, as illustrated in the example of FIG. 9, in a case where the air bubbles adhere to the vicinity of the nozzle N, by the size of a diameter thereof, the diameter of the nozzle N becomes larger and the acoustic resistance r is considered to be decreased.

Figure 10:
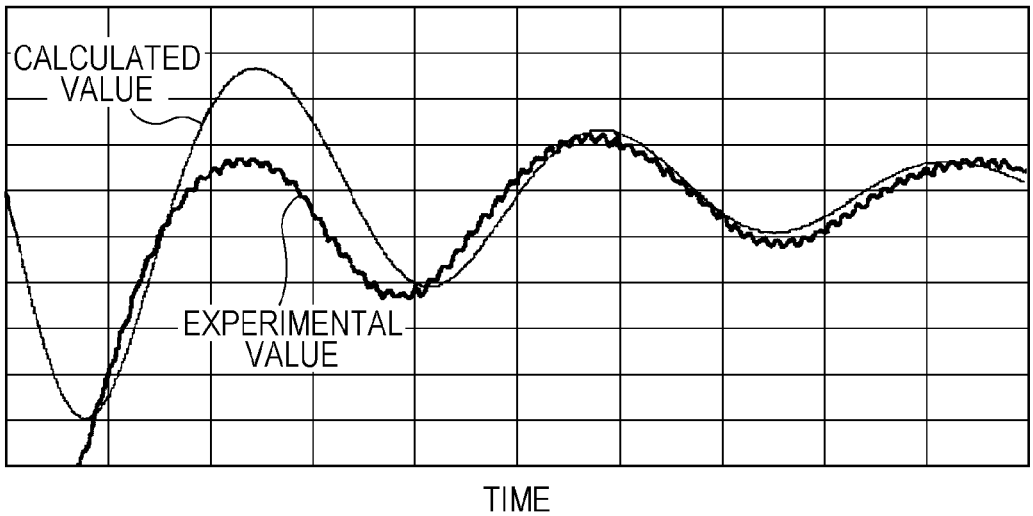
FIG. 10 is a graph illustrating the experimental value and the calculated value of the residual vibration in a state where an ink cannot be discharged due to the air bubble incorporated in the cavity.

Therefore, in a case of FIG. 8 where the ink is discharged normally, both the acoustic resistance r and the inertance m are set to be small and match the experimental value of the residual vibration at a time when the air bubble is incorporated. Accordingly, the result (graph) illustrated in FIG. 10 is obtained. As seen in the graphs in FIG. 8 and FIG. 10, in a case where the air bubbles are incorporated in the cavity 245, a unique residual vibration waveform is obtained in which a frequency is high compared to the frequency during normal discharging. In addition, as the acoustic resistance r decreases, a damping factor of an amplitude of the residual vibration also becomes smaller. It is possible to confirm that the residual vibration gradually decreases in the amplitude.

Figure 11:
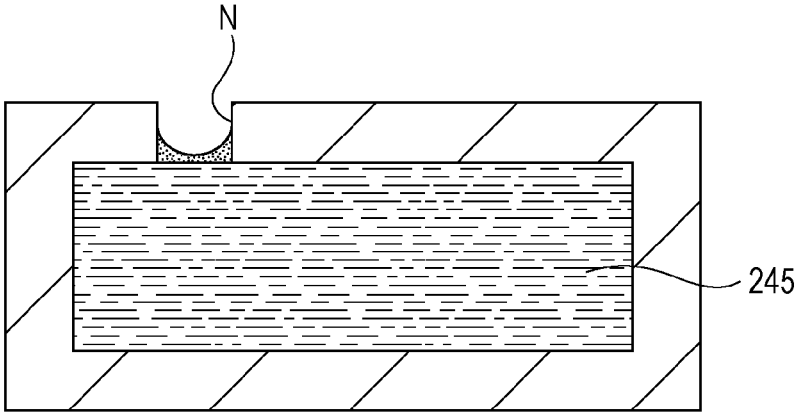
FIG. 11 is a view illustrating a state of the discharging unit in a case where the ink in the vicinity of a nozzle is fixed.

Next, another reason for the dot omission will be described. (2) Dried (fixed, thickened) ink in the vicinity of the nozzle N is inspected. FIG. 11 is a schematic view of the vicinity of the nozzle N in a case where the ink in the vicinity of the nozzle N in FIG. 4 has dried and become fixed. As illustrated in FIG. 11, in a case where the ink in the vicinity of the nozzle N has dried and become fixed, the ink inside the cavity 245 is confined in the cavity 245. In this manner, in a case where the ink in the vicinity of the nozzle N has dried and become thickened, the acoustic resistance r is considered to be increased.

Figure 12:
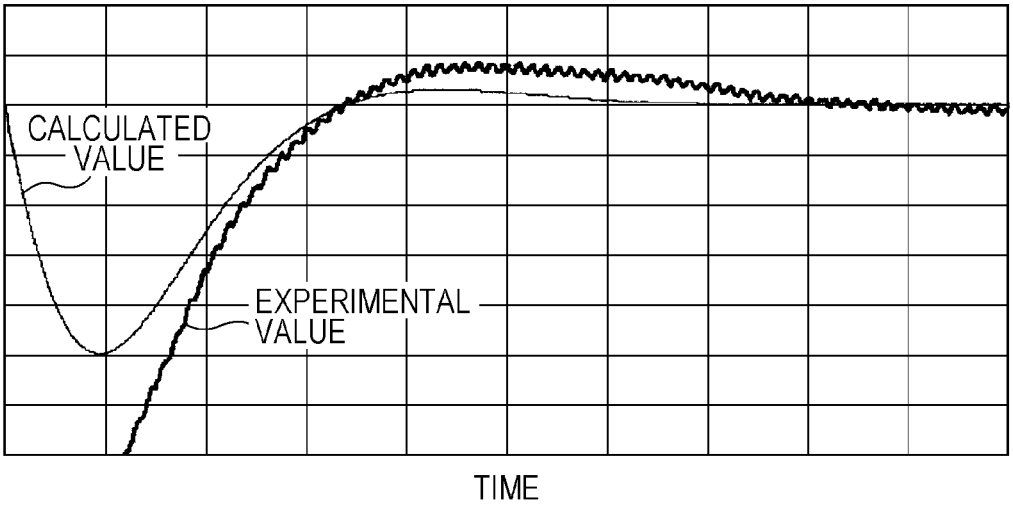
FIG. 12 is a graph illustrating the experimental value and the calculated value of the residual vibration in a state where the ink cannot be discharged due to the fixation of the ink in the vicinity of the nozzle.

Therefore, in a case of FIG. 8 where the ink is discharged normally, the acoustic resistance r is set to be large and matches the experimental value of the residual vibration at a time when the ink in the vicinity of the nozzle N has dried and become fixed (thickened). Accordingly, the result (graph) illustrated in FIG. 12 is obtained. In addition, the experimental value illustrated in FIG. 12 is a result of measuring the residual vibration of the vibration plate 243 in a state where the discharging unit 35 is left with a cap (not illustrated) not being mounted for several days and the ink cannot be discharged (the ink is fixed) as the ink in the vicinity of the nozzle N has dried and thickened. As seen in the graphs in FIG. 8 and FIG. 12, in a case where the ink in the vicinity of the nozzle N has dried and become fixed, the frequency is extremely low compared to the frequency during normal discharging, and a unique residual vibration waveform can be obtained in which the residual vibration becomes overdamping. This is because the vibration plate 243 cannot rapidly vibrate (is overdamped) since an escape route of the ink inside the cavity 245 does not exist when the vibration plate 243 moves upward in FIG. 4 after the ink flows into the cavity 245 from the reservoir 246 as the vibration plate 243 is pulled downward in FIG. 4 to discharge the ink droplets.

Figure 13:
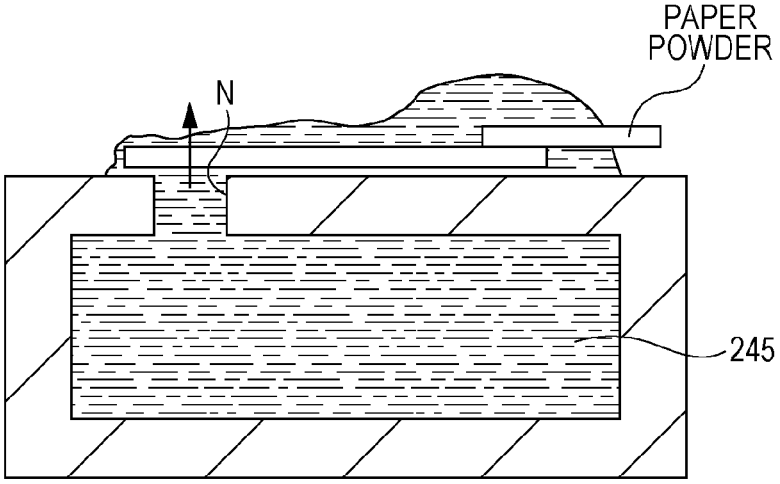
FIG. 13 is a view illustrating a state of the discharging unit in a case where paper powder is adhered to the vicinity of an outlet of the nozzle.

Next, yet another reason for the dot omission will be described. (3) Adhered paper powder in the vicinity of the outlet of the nozzle N is inspected. FIG. 13 is a schematic view of the vicinity of the nozzle N in a case where the paper powder adheres to the vicinity of the outlet of the nozzle N in FIG. 4. As illustrated in FIG. 13, in a case where the paper powder adheres to the vicinity of the outlet of the nozzle N, the ink permeates via the paper powder from the inside of the cavity 245, and it is not possible to discharge the ink from the nozzle N. In this manner, the paper powder adheres to the vicinity of the outlet of the nozzle N. In a case where the ink permeates from the nozzle N, the volume of the ink inside the cavity 245 and the volume of the ink permeated increase to larger than that at a normal time when viewed from the vibration plate 243. Accordingly, the inertance m is considered to be increased. In addition, the acoustic resistance r is considered to be increased due to fibers of the paper powder adhered to the vicinity of the outlet of the nozzle N.

Figure 14:
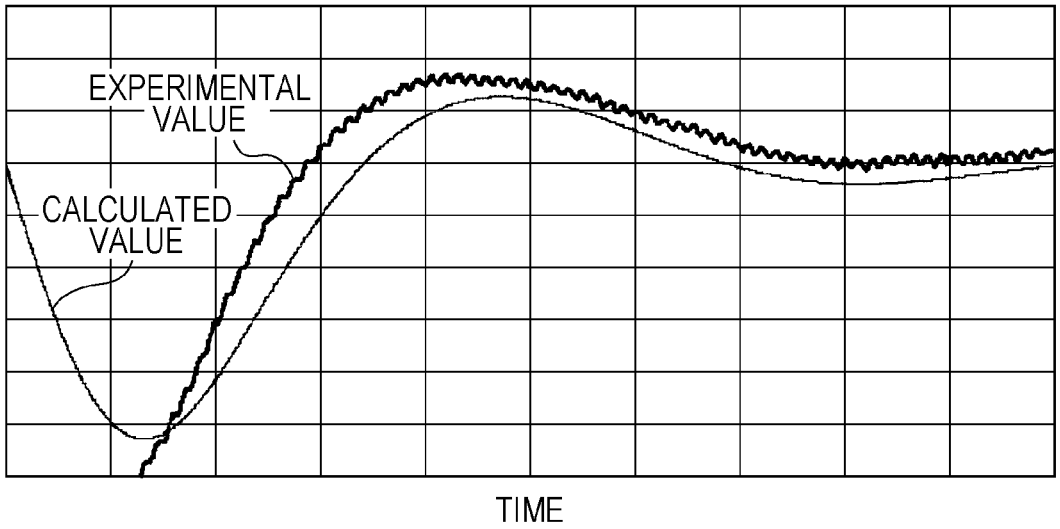
FIG. 14 is a graph illustrating the experimental value and the calculated value of the residual vibration in a state where the ink cannot be discharged due to the adherence of the paper powder to the vicinity of the outlet of the nozzle.

Therefore, in a case of FIG. 8 where the ink is discharged normally, the inertance m and the acoustic resistance r are set to be large and match the experimental value of the residual vibration at a time when the paper powder adheres to the vicinity of the outlet of the nozzle N. Accordingly, the result (graph) illustrated in FIG. 14 is obtained. As seen in the graphs in FIG. 8 and FIG. 14, in a case where the paper powder adheres to the vicinity of the outlet of the nozzle N, a unique residual vibration waveform can be obtained in which the frequency becomes low compared to the frequency during normal discharging.

In addition, in a case where the paper powder adheres, compared to a case where the ink has dried, higher frequency of the residual vibration can be seen in the graphs in FIG. 12 and FIG. 14.

Here, in both of the cases where the ink in the vicinity of the nozzle N has dried and thickened and where the paper powder adheres to the vicinity of the outlet of the nozzle N, the frequency of the damping vibration is low compared to a case where the ink droplets are discharged normally. In order to identify both of the reasons for the dot omission (ink non-discharge: discharge abnormality) from the waveform of the residual vibration of the vibration plate 243, it is possible to compare the frequency or a cycle of the damping vibration, and a phase having a predetermined threshold value, or it is possible to identify the reason from a cycle change of the residual vibration (damping vibration) or a damping factor of an amplitude change. In this manner, it is possible to detect the discharge abnormality of each discharging unit 35 by a change in residual vibration of the vibration plate 243, particularly, a change in the frequency thereof when the ink droplets are discharged from the nozzle N in each discharging unit 35. In addition, by comparing the frequency of the residual vibration in this case with the frequency of the residual vibration in a case of normal discharging, it is possible to identify the reason for the discharge abnormality.

The ink jet printer 1 according to the embodiment analyzes the residual vibration and detects the discharge abnormality.

Next, a configuration and an operation of the head driver 50 (driving signal generation unit 51, discharge abnormality detection unit 52, and switching unit 53) will be described with reference to FIGS. 15 to 21.

Figures 15, 16:
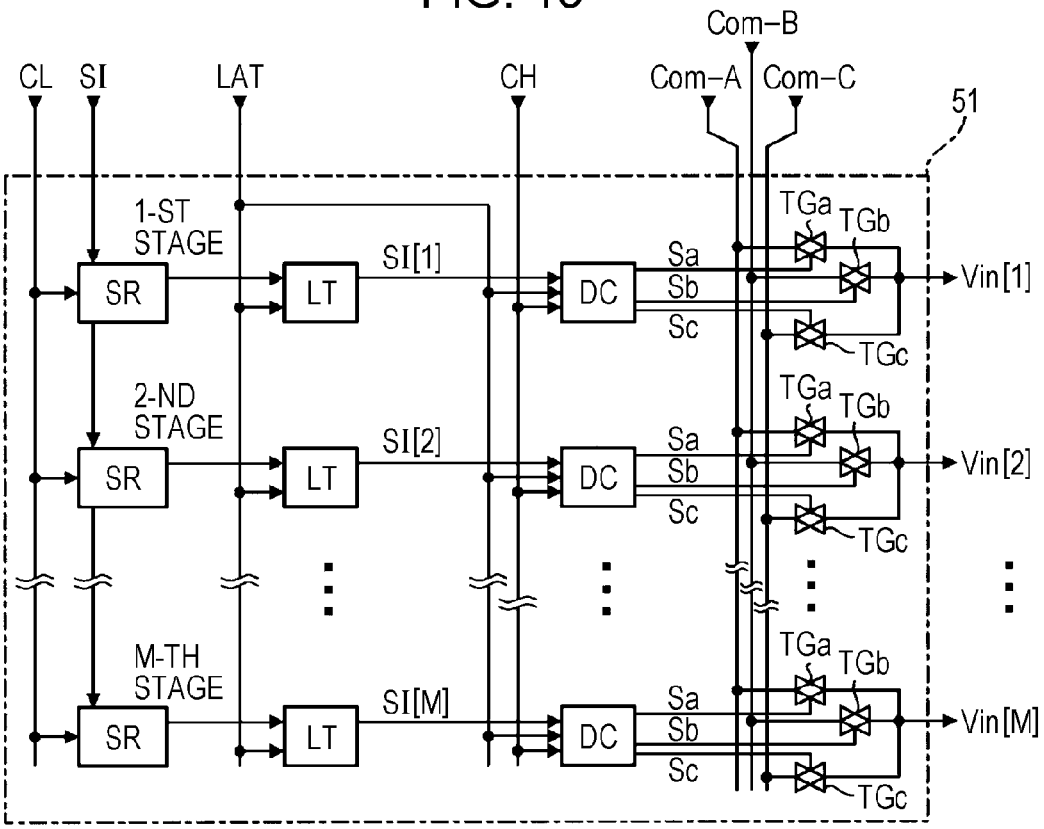
FIG. 15 is a block diagram illustrating a configuration of a driving signal generation unit.
FIG. 16 is a view illustrating a decoded content of a decoder.

FIG. 15 is a block diagram illustrating a configuration of the driving signal generation unit 51 in the head driver 50. As illustrated in FIG. 15, the driving signal generation unit 51 includes a shift register SR, a latch circuit LT, a decoder DC, and M groups having transmission gates TGa, TGb, and TGc which are respectively in one-to-one correspondence with M discharging units 35. Hereinafter, each element which constitutes the M groups is referred to as a 1st stage, a 2nd stage, . . . , an M-th stage in order from above in the drawing.

In addition, the discharge abnormality detection unit 52 will be described in detail. The discharge abnormality detection unit 52 includes M discharge abnormality detection circuits DT (DT[1], DT[2], . . . , DT[M]) so as to be respectively in one-to-one correspondence with M discharging units 35.

The driving signal generation unit 51 is supplied with a clock signal CL, a printing signal SI, a latch signal LAT, a change signal CH, and driving waveform signals Com (Com-A, Com-B, Com-C) from the control unit 6.

Here, the printing signal SI is a digital signal that defines the volume of the ink discharged from each discharging unit 35 (each nozzle N) when one dot of the image is formed. More specifically, the printing signal SI according to the embodiment defines the volume of the ink discharged from each discharging unit 35 (each nozzle N) by 3 bits, such as a high-order bit b1, a middle-order bit b2, and a low-order bit b3. The printing signals SI are synchronized by the control unit 6 with the clock signal CL and are supplied serially to the driving signal generation unit 51. By controlling the volume of the ink discharged from each discharging unit 35 by the printing signal SI, in each dot on the recording paper P, it is possible to express four gradations including non-recording, a small dot, a medium dot, and a large dot, and it is further possible to generate the residual vibration and create the driving signal for inspection in order to inspect the discharge state of the ink.

Each of shift resistors SR temporarily maintain the printing signal SI every 3 bits corresponding to each discharging unit 35. Specifically, M shift resistors SR having the 1st stage, the 2nd stage, . . . , the M-th stage are connected in a cascade arrangement to each other, respectively in one-to-one correspondence with M discharging units 35, and the printing signals SI are sequentially transmitted to the following stage according to the clock signal CL. At a time when the printing signal SI is transmitted to all of the M shift resistors SR, the supply of the clock signal CL is stopped, and a state where each of the M shift resistors SR holds 3-bit data in the printing signals SI corresponding to the shift resistor SR itself is maintained.

At a time when the latch signal LAT rises, each of the M latch circuits LT simultaneously latches the 3-bit printing signals SI which are maintained in each of M shift resistors SR and correspond to each stage. In FIG. 15, each of SI[1], SI[2], . . . , SI[M] shows the 3-bit printing signals SI which are latched respectively according to the latch circuits LT corresponding to the shift resistors SR having the 1st stage, the 2nd stage, . . . , the M-th stage.

However, the printing operation period in which the ink jet printer 1 forms the image on the recording paper P and performs the printing includes a plurality of unit operation periods Tu.

The control unit 6 allocates the unit operation period Tu to the printing process or to the discharge abnormality detection process in each of M discharging units 35. The control unit 6 controls the discharging unit 35 in a state where there are three modes. A first mode allocates the printing process to a part of M discharging units 35, and the discharge abnormality detection process to another part. A second mode allocates the printing process to the entire M discharging units 35. A third mode allocates the discharge abnormality detection process to the entire M discharging units 35.

Each unit operation period Tu has a control period Tc1 and a control period Tc2 which follows the control period Tc1. In the embodiment, the control period Tc1 and the control period Tc2 have a time length equal to each other.

The control unit 6 supplies the printing signal SI every unit operation period Tu with respect to the driving signal generation unit 51, and the latch circuit LT latches the printing signals SI[1], SI[2], . . . , SI[M] every unit operation period Tu.

The decoder DC decodes the 3-bit printing signal SI which is latched by the latch circuit LT. In each of the control period Tc1 and the control period Tc2, selecting signals Sa, Sb, and Sc are output.

FIG. 16 is a view (table) illustrating content of the decoding which is performed by the decoder DC. As illustrated in the drawing, when the content which shows the printing signal SI[m] corresponding to the m-th stage (m is a natural number which satisfies $1 \leq m \leq M$) is, for example, in case of (b1, b2, b3)=(1, 0, 0), the decoder DC on the m-th stage sets the selecting signal Sa to a high level H and sets the selecting signals Sb and Sc to a low level L, during the control period Tc1. In addition, during the control period Tc2, the decoder DC sets the selecting signals Sa and Sc to the low level L and sets the selecting signal Sb to the high level H.

In case of the low-order bit b3 is 1, regardless of values of the high-order bit b1 and the middle-order bit b2, during the control periods Tc1 and Tc2, the decoder DC on the m-th stage sets the selecting signals Sa and Sb to the low level L and sets the selecting signal Sc to the high level H.

The description returns to FIG. 15. As illustrated in FIG. 15, the driving signal generation unit 51 has M groups of transmission gates TGa and TGb so as to have one-to-one correspondence with M discharging units 35.

The transmission gate TGa is ON when the selecting signal Sa is at H level, and OFF when the selecting signal Sa is at L level. The transmission gate TGb is ON when the selecting signal Sb is at H level, and OFF when the selecting signal Sb is at L level. The transmission gate TGc is ON when the selecting signal Sc is at H level, and OFF when the selecting signal Sc is at L level.

For example, on the m-th stage, in a case where content which shows the printing signal SI[m] is (b1, b2, b3)=(1, 0, 0), the transmission gate TGa during the control period Tc1 is ON and the transmission gates TGb and TGc are OFF. In addition, the transmission gates TGa and TGc during the control period Tc2 are OFF and the transmission gate TGb is ON.

The driving waveform signal Com-A is supplied to one end of the transmission gate TGa, the driving waveform signal Com-B is supplied to one end of the transmission gate TGb, and the driving waveform signal Com-C is supplied to one end of the transmission gate TGc. In addition, the other ends of the transmission gates TGa, TGb, and TGc are connected to each other.

The transmission gates TGa, TGb, and TGc become exclusively ON. The driving waveform signals Com-A, Com-B, and Com-C selected every control period Tc1 and Tc2 are output as the driving signal Vin[m] and supplied to the discharging unit 35 of the m-th stage via the switching unit 53.

Figure 17:
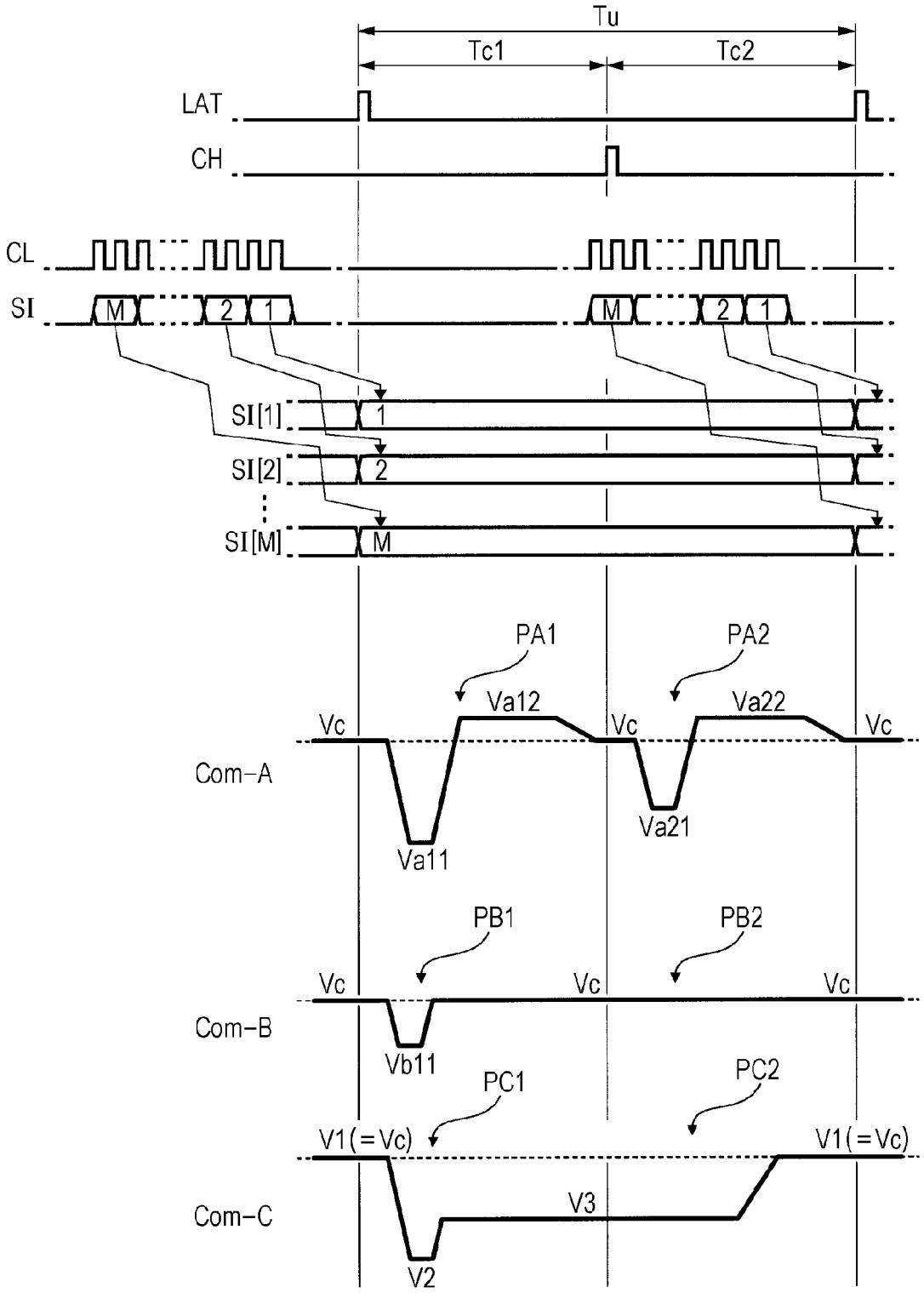
FIG. 17 is a timing chart illustrating an operation of the driving signal generation unit during a unit operation period.

FIG. 17 is a timing chart for describing the operation of the driving signal generation unit 51 during the unit operation period Tu. As illustrated in FIG. 17, the unit operation period Tu is defined by the latch signal LAT output by the control unit 6. In addition, each unit operation period Tu is defined by the latch signal LAT and the change signal CH, and has the control periods Tc1 and Tc2 which have a time length equal to each other.

As illustrated in FIG. 17, the driving waveform signal Com-A supplied from the control unit 6 during the unit operation period Tu is a waveform in which a unit waveform PA1 disposed in the control period Tc1 in the unit operation period Tu and a unit waveform PA2 disposed in the control period Tc2 are sequential. Both of the electric potentials at a timing of starting and ending the unit waveform PA1 and the unit waveform PA2 are reference potentials Vc. In addition, as illustrated in the drawing, the potential difference between an electric potential Va11 and an electric potential Va12 of the unit waveform PA1 is larger than the potential difference between an electric potential Va21 and an electric potential Va22 of the unit waveform PA2. For this reason, in a case where the piezoelectric element 200 provided in each discharging unit 35 is driven by the unit waveform PA1, the volume of the ink discharged from the nozzle N provided in the discharging unit 35 is larger than the volume of the ink discharged in a case where the piezoelectric element 200 is driven by the unit waveform PA2.

The driving waveform signal Com-B supplied from the control unit 6 in the unit operation period Tu is a waveform in which a unit waveform PB1 disposed during the control period Tc1 and a unit waveform PB2 disposed during the control period Tc2 are sequential. Both of the electric potentials at a timing of starting and ending the unit waveform PB1 are reference potentials Vc, and the unit waveform PB2 is held at the reference potential Vc over the control period Tc2. In addition, the potential difference between the electric potential Vb11 and the reference potential Vc of the unit waveform PB1 is smaller than the potential difference between the electric potential Va21 and the electric potential Va22 of the unit waveform PA2. Even in a case where the piezoelectric element 200 provided in each discharging unit 35 is driven by the unit waveform PB1, the ink is not discharged from the nozzle N provided in the discharging unit 35. Similarly, even in a case where the unit waveform PB2 is supplied to the piezoelectric element 200, the ink is not discharged from the nozzle N.

The driving waveform signal Com-C supplied from the control unit 6 during the unit operation period Tu is a waveform in which a unit waveform PC1 disposed during the control period Tc1 and a unit waveform PC2 disposed during the control period Tc2 are sequential. Both of the electric potentials at a timing of starting the unit waveform PB1 and a timing of ending the unit waveform PB2 are a first electric potential V1 (in this example, reference potential Vc). The unit waveform PB1 is shifted from the first electric potential V1 to a second electric potential V2, further, is shifted from the second electric potential V2 to a third electric potential V3, and is held at the third electric potential V3. In addition, after the third electric potential V3 is maintained, the unit waveform PB2 is shifted from the third electric potential V3 to the first electric potential V1, and is held at the first electric potential V1 is held. The driving waveform signal Com-C is selected when the discharge state of the ink is inspected. In addition, the first electric potential (reference potential Vc) of this example is set to an electric potential to be maintained in the piezoelectric element 200 when the ink is not discharged.

As described above, the M latch circuits LT output the printing signals SI[1], SI[2], . . . , SI[M] at a timing when the latch signal LAT rises, that is, at a timing of starting the unit operation period Tu (Tp or Tt).

In addition, as described above, the decoder DC on the m-th stage outputs the selecting signals Sa, Sb, and Sc based on the content of the table illustrated in FIG. 16 during each of the control periods Tc1 and Tc2 corresponding to the printing signal SI[m].

In addition, as described above, based on the selecting signals Sa, Sb, and Sc, the transmission gates TGa, TGb, and TGc on the m-th stage select any one of the driving waveform signals Com-A, Com-B, and Com-C, and output the selected driving waveform signal Com as the driving signal Vin[m].

Figure 18:
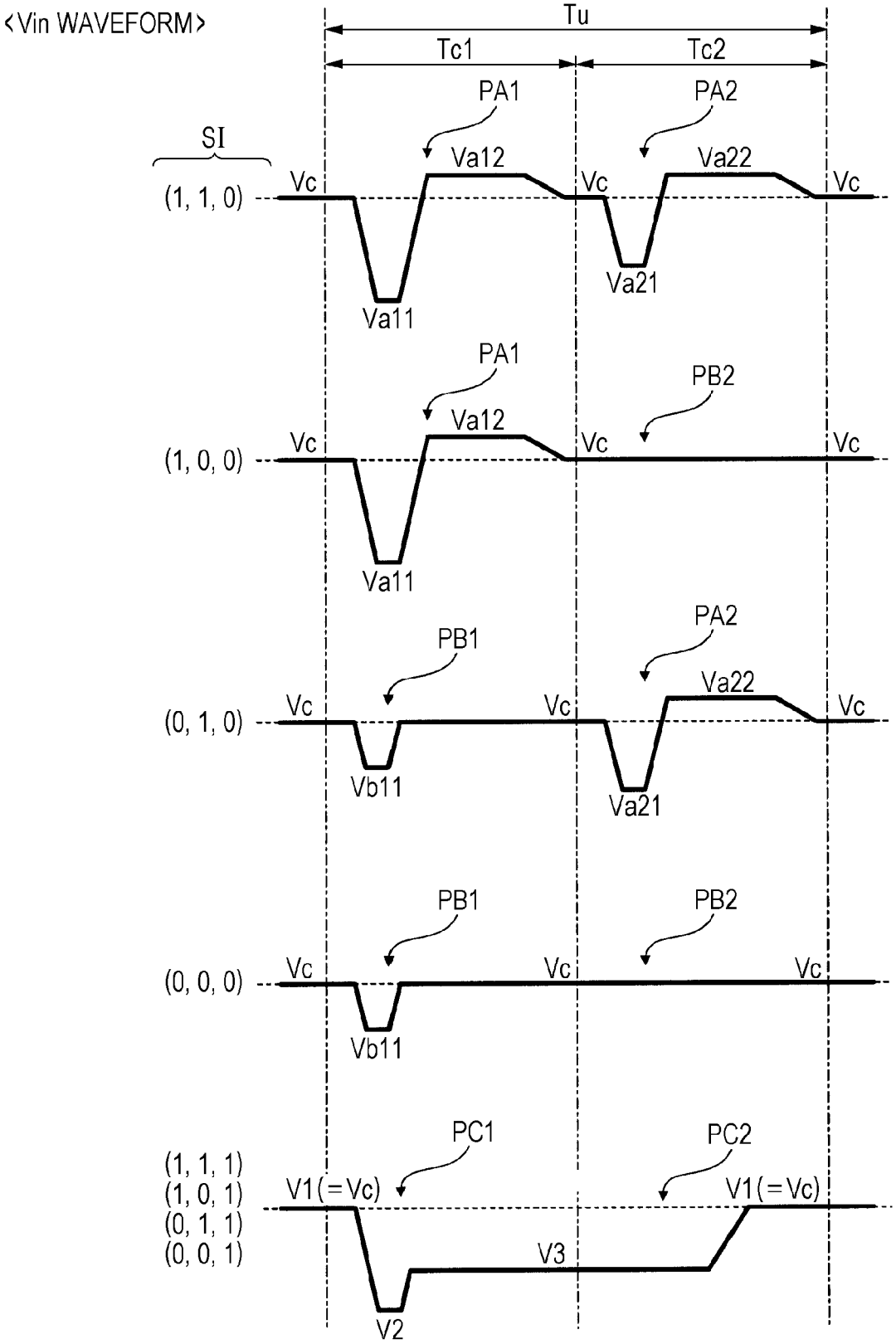
FIG. 18 is a timing chart illustrating a waveform of the driving signal during the unit operation period.

In addition to FIGS. 15 to 17, with reference to FIG. 18, the waveform of the driving signal Vin output by the driving signal generation unit 51 during the unit operation period Tu will be described.

In a case where the content of the printing signal SI[m] supplied during the unit operation period Tu is (b1, b2, b3)=(1, 1, 0), during the control period Tc1 and the control period Tc2, the selecting signals Sa, Sb, and Sc become H level, L level, and L level, respectively. Therefore, the driving waveform signal Com-A is selected by the transmission gate TGa, and the unit waveform PA1 and the unit waveform PA2 are output as the driving signal Vin[m]. In addition, during the control period Tc2, the selecting signals Sa, Sb, and Sc become H level, L level, and L level, respectively. Therefore, the driving waveform signal Com-A is selected by the transmission gate TGa and the unit waveform PA2 is output as the driving signal Vin[m].

As a result, during the unit operation period Tu, the discharging unit 35 on the m-th stage discharges the ink to an amount of a medium extent based on the unit waveform PA1 and discharges the ink to an amount of a small extent based on the unit waveform PA2. Since the ink discharged two times is combined on the recording paper P, large dots are formed on the recording paper P.

In a case where the content of the printing signal SI[m] supplied during the unit operation period Tu is (b1, b2, b3)=(1, 0, 0), during the control period Tc1, the selecting signals Sa, Sb, and Sc become H level, L level, and L level, respectively. Therefore, the driving waveform signal Com-A is selected by the transmission gate TGa and the unit waveform PA1 is output as the driving signal Vin[m]. In addition, during the control period Tc2, the selecting signals Sa, Sb, and Sc become L level, H level, and L level, respectively. Therefore, the driving waveform signal Com-B is selected by the transmission gate TGb and the unit waveform PB2 is output as the driving signal Vin[m].

As a result, during the unit operation period Tu, the discharging unit 35 on the m-th stage discharges the ink to the amount of a medium extent based on the unit waveform PA1, and medium dots are formed on the recording paper P.

In a case where the content of the printing signal SI[m] supplied during the unit operation period Tu is (b1, b2, b3)=(0, 1, 0), during the control period Tc1, the selecting signals Sa, Sb, and Sc become L level, H level, and L level, respectively. Therefore, the driving waveform signal Com-B is selected by the transmission gate TGb and the unit waveform PB1 is output as the driving signal Vin[m]. In addition, during the control period Tc2, the selecting signals Sa, Sb, and Sc become H level, L level, and L level, respectively. Therefore, the driving waveform signal Com-A is selected by the transmission gate TGa and the unit waveform PA2 is output as the driving signal Vin[m].

As a result, during the unit operation period Tu, the discharging unit 35 on the m-th stage discharges the ink to the amount of a small extent based on the unit waveform PA2, and small dots are formed on the recording paper P.

In a case where the content of the printing signal SI[m] supplied during the unit operation period Tu is (b1, b2, b3)=(0, 0, 0), during the control periods Tc1 and Tc2, the selecting signals Sa, Sb, and Sc become L level, H level, and L level, respectively. Therefore, the driving waveform signal Com-B is selected by the transmission gate TGb and the unit waveforms PB1 and PB2 are output as the driving signal Vin[m].

As a result, during the unit operation period Tu, the discharging unit 35 on the m-th stage does not discharge the ink, and dots are not formed on the recording paper P (non-recording).

In a case where the content of the printing signal SI[m] supplied during the unit operation period Tu is (b1, b2, b3)=(1 or 0, 1 or 0, 1), during the control periods Tc1 and Tc2, the selecting signals Sa, Sb, and Sc become L level, L level, and H level, respectively. Therefore, the driving waveform signal Com-C is selected by the transmission gate TGc and the unit waveforms PC1 and PC2 are output as the driving signal Vin[m].

As a result, during the unit operation period Tu, the discharging unit 35 on the m-th stage does not discharge the ink, and an inspection of the discharge state of the ink is performed.

Figure 19:
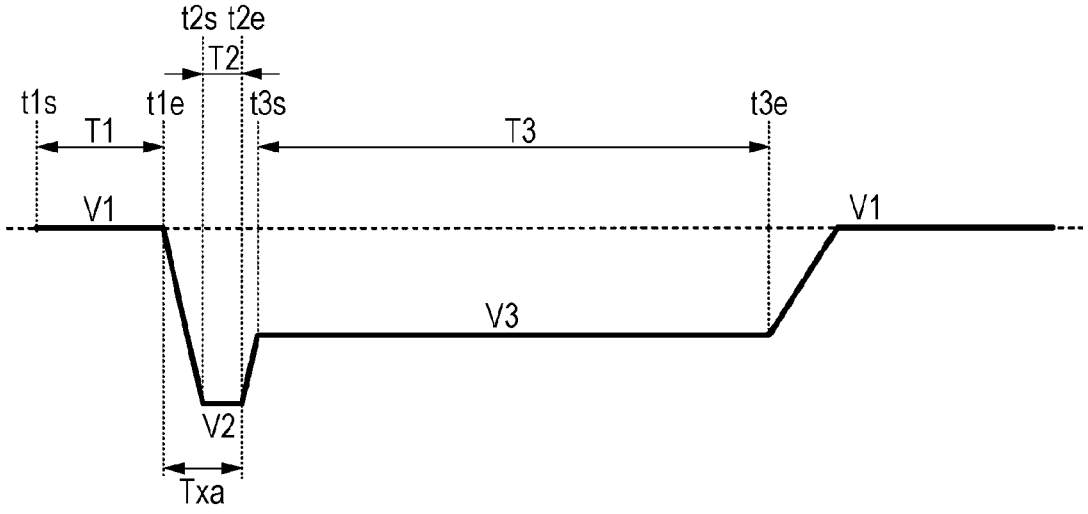
FIG. 19 is a waveform diagram illustrating the waveform of the driving signal for inspection.

FIG. 19 illustrates a waveform of the driving signal Vin[m] for inspection. As illustrated in the drawing, the driving signal Vin[m] becomes the first electric potential V1 during a first period T1 from a time t1s to a time t1e, becomes the second electric potential V2 during a second period T2 from a time t2s to a time t2e, and becomes the third electric potential V3 during a third period T3 from a time t3s to a time t3e. In addition, the driving signal Vin[m] is shifted from the first electric potential V1 to the second electric potential V2 (t1e to t2s), and is shifted from the second electric potential V2 to the third electric potential V3 (t2e to t3s).

In this example, during the period from the time t1e to t2s at which the first electric potential V1 is shifted to the second electric potential V2, an electric charge which is charged to the piezoelectric element 200 is discharged. As a result, the piezoelectric element 200 excites a meniscus to be pulled into the cavity 245. Then, during the second period T2, the second electric potential V2 is maintained, and during the period from the time t2e to the time t3s, the second electric potential V2 is shifted to the third electric potential V3. During the period from the time t2e to the time t3s, the electric charge is charged to the piezoelectric element 200. As a result, the piezoelectric element 200 is displaced in a direction of pushing the meniscus to the outside of the cavity 245. Here, the third electric potential V3 is set so that the ink is not discharged from the nozzle N. If the second electric potential V2 is shifted to the first electric potential V1, the displacement of the piezoelectric element 200 is restored to the original state in a short time, and the ink is discharged.

In this case, in the embodiment, the third electric potential V3 is set to be an electric potential between the first electric potential V1 and the second electric potential V2. In other words, in this example, by restoring the meniscus from the state where the meniscus is pulled into the cavity 245 if it is possible not to discharge the ink, a large pressure change is generated inside the cavity 245. Accordingly, it is possible to extract the residual vibration at a large amplitude.

In addition, in the embodiment, when a time from the ending time t1e of the first period T1 to the ending time t2e of the second period T2 is set to Txa, and when the natural vibration cycle of the cavity 245 is set to Tc, it is preferable that the time Txa be determined as follows.

Figure 20:
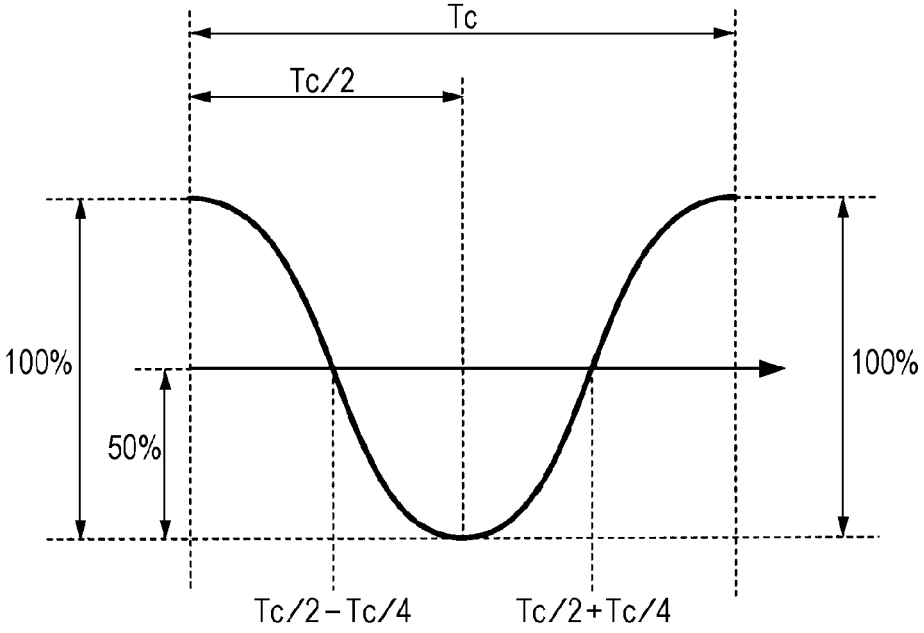
FIG. 20 is a view illustrating a pressure change in the cavity.

As the piezoelectric element 200 is bent, the ink inside the cavity 245 is excited. At this time, the pressure inside cavity 245 increases and decreases in synchronization with the natural vibration cycle Tc. Meanwhile, the ending time t2e of the second period T2 is a timing at which a direction of the displacement of the piezoelectric element 200 is changed. In order to obtain a large residual vibration, it is preferable to change the direction of the displacement of the piezoelectric element 200 in synchronization with a change in the pressure inside the cavity 245. In this case, the pressure inside the cavity illustrated in FIG. 20 is changed from decreasing to increasing at a timing when the time Txa is equal to Tc/2. Accordingly, it is preferable that the time Txa be equal to Tc/2.

In addition, a range from [Tc/2−Tc/4] to [Tc/2+Tc/4] is a range of 50% of the maximum amplitude. Accordingly, by setting the time Txa to satisfy the following expression (1), it is possible to enhance the efficiency compared with a case where the time Txa is in a range from [0] to [Tc/2−Tc/4], or a case where the time Txa is in a range from [Tc/2+Tc/4] to [Tc].

$$Tc/2-Tc/4<Txa<Tc/2+Tc/4 \quad (1)$$

Particularly, since the range from Tc/2 to Tc/2+Tc/4 is a range after the pressure is changed from decreasing to increasing, it is possible to further enhance the efficiency by setting the time Txa within the range.

However, the third period T3 detects the residual vibration in the discharge abnormality detection unit 52. In order to sufficiently detect the residual vibration, the third period T3 is longer than the second period T2. In addition, in analyzing the residual vibration, it is important to actually detect the natural vibration cycle Tc of the cavity 245 in order to specify the discharge state of the ink. Accordingly, the third period T3 is set to be longer than the natural vibration cycle Tc.

Furthermore, in inspecting the discharge state of the ink, the residual vibration is actively used, but in normal printing, if an effect of the residual vibration generated in the unit operation period Tu, which is one period earlier, is received, there is a case where the discharge of the ink is adversely affected. Here, it is preferable to specify the length of the third period T3 so as to remove the residual vibration. More specifically, the third period T3 may be set such that the third period T3 is a natural number times the natural vibration cycle Tc. In addition, similarly to the above-described setting of the time Txa, by setting the third period T3 to satisfy an expression (2), it is possible to efficiently remove the residual vibration.

$$k\cdot Tc-Tc/4<T3<k\cdot Tc+Tc/4 \quad (2)$$

Here, k is a natural number.

The ink jet printer 1 according to the embodiment drives the discharging unit 35 by the driving signal Vin for inspection, and as a result, the pressure change inside the cavity 245 of the discharging unit 35 is generated. Based on the pressure change, a change in the electromotive force of the piezoelectric element 200 is detected as the residual vibration signal Vout. The discharge abnormality detection process is performed which determines whether or not the discharge abnormality exists in the discharging unit 35 based on the residual vibration signal Vout.

Figure 21:
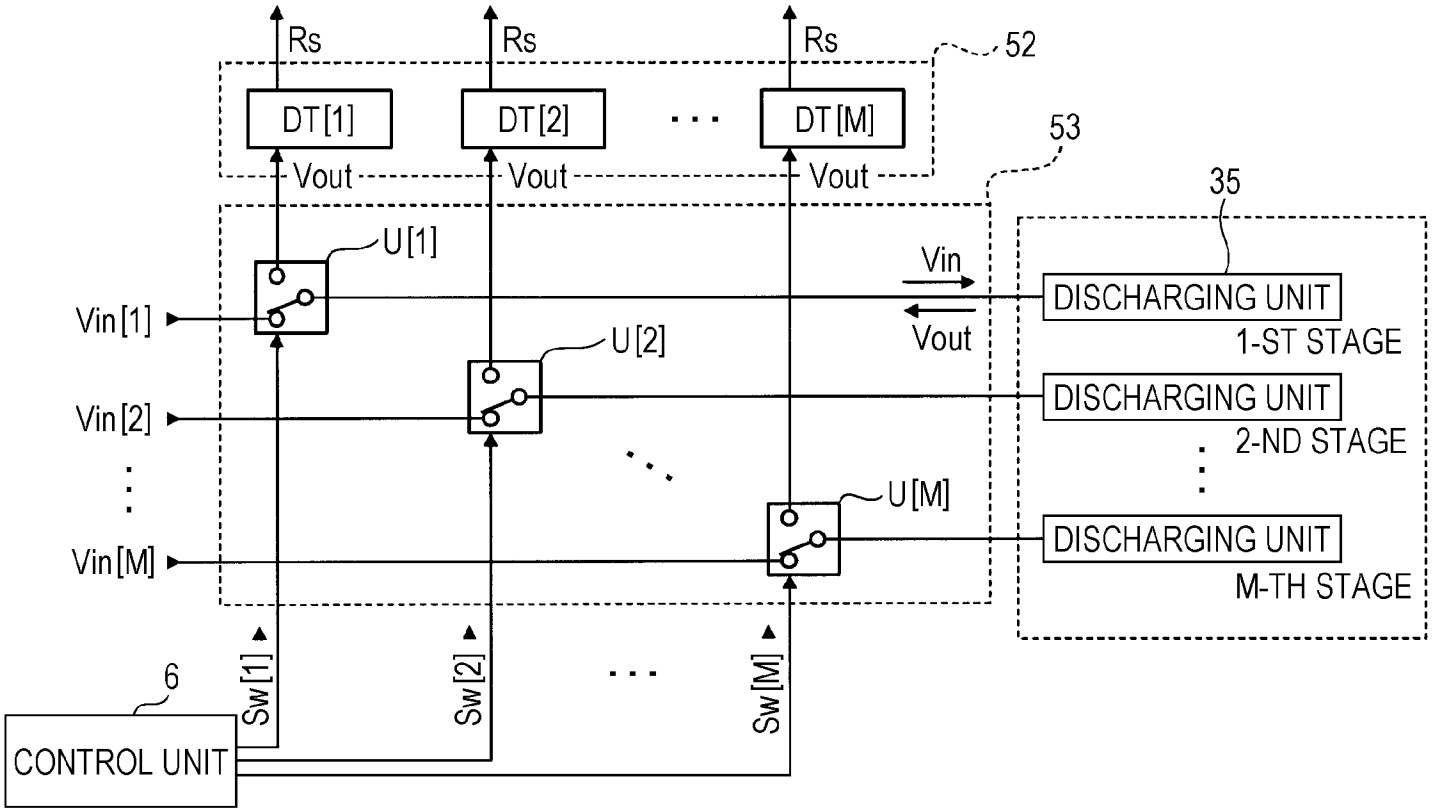
FIG. 21 is a block diagram illustrating a configuration of a switching unit.

FIG. 21 is a block diagram illustrating a configuration of the switching unit 53 in the head driver 50 and an electrical connection relationship of the switching unit 53, the discharge abnormality detection unit 52, the head unit 30, and the driving signal generation unit 51.

As illustrated in FIG. 21, the switching unit 53 has M switching circuits U (U[1], U[2], . . . , U[M]) from the 1st stage to the M-th stage in one-to-one correspondence with M discharging units 35. The switching circuit U[m] on the m-th stage electrically connects the discharging unit 35 on the m-th stage to any one of a wiring supplied with the driving signal Vin[m] or to any one of the discharge abnormality detection circuit DT provided in the discharge abnormality detection unit 52.

Hereinafter, in each switching circuit U, a state where the discharging unit 35 and the driving signal generation unit 51 are electrically connected to each other is referred to as a first connection state. In addition, a state where the discharging unit 35 and the discharge abnormality detection circuit DT of the discharge abnormality detection unit 52 are electrically connected to each other is referred to as a second connection state.

The control unit 6 supplies the switching control signal Sw[m] to control the connection state of the switching circuit U[m] with respect to the switching circuit U[m] on the m-th stage.

Specifically, during the unit operation period Tu, the control unit 6 outputs the switching control signals Sw[1], Sw[2], . . . , Sw[M] to set the switching circuit corresponding to the discharging unit 35 which performs printing to the first connection state, and to set the switching circuit corresponding to the discharging unit 35 which is a target of the inspection to the second connection state. That is, during the unit operation period Tu, the switching control signals Sw that designate the first connection state and the second connection state may be mixed, the entire switching control signals Sw may designate the first connection state, and the entire switching control signals Sw may designate the second connection state.

Figure 22:
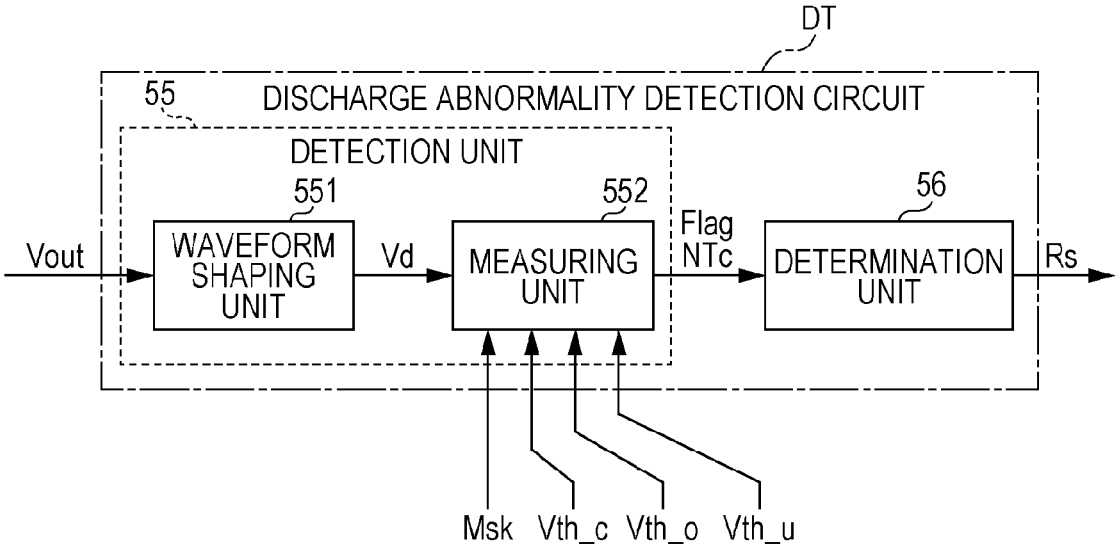
FIG. 22 is a block diagram illustrating a configuration of a discharge abnormality detection circuit DT.

FIG. 22 is a block diagram illustrating a configuration of the discharge abnormality detection circuit DT provided in the discharge abnormality detection unit 52 in the head driver 50.

As illustrated in FIG. 22, the discharge abnormality detection circuit DT has: the detection unit 55 which outputs the detection signal NTc which represents a time length of one cycle of the residual vibration of the discharging unit 35 based on the residual vibration signal Vout; and the determination unit 56 which outputs the determination result signal Rs which represents the determination result by determining whether the discharge abnormality is present or absent in the discharging unit 35, or by determining the discharging state in a case where the discharge abnormality exists based on the detection signal NTc.

Among those, the detection unit 55 has a waveform shaping unit 551 which generates the shaped waveform signal Vd that removes a noise component from the residual vibration signal Vout output from the discharging unit 35, and a measuring unit 552 which generates the detection signal NTc based on the shaped waveform signal Vd.

The waveform shaping unit 551 has, for example, a high-pass filter for outputting a signal which damps low-pass frequency components that are lower than a frequency band of the residual vibration signal Vout, a low pass filter for outputting a signal which damps high-pass frequency components that are higher than the frequency band of the residual vibration signal Vout, or the like. The waveform shaping unit 551 is configured to output the shaped waveform signal Vd in which the frequency range of the residual vibration signal Vout is limited and a noise component is removed.

In addition, the waveform shaping unit 551 may be configured to have an amplifier of a negative feedback type for adjusting the amplitude of the residual vibration signal Vout, a voltage follower for changing an impedance of the residual vibration signal Vout and outputting the shaped waveform signal Vd of a low impedance, or the like.

The measuring unit 552 is supplied with the shaped waveform signal Vd which is made by shaping the residual vibration signal Vout in the waveform shaping unit 551, a mask signal Msk generated by the control unit 6, a threshold electric potential Vth_c specified as an electric potential of an amplitude center level of the shaped waveform signal Vd, a threshold electric potential Vth_o specified as an electric potential which is higher than the threshold electric potential Vth_c, and a threshold electric potential Vth_u specified as an electric potential which is lower than the threshold electric potential Vth_c. Based on these signals, and the like, the measuring unit 552 outputs a validity Flag which shows the detection signal NTc and whether or not the detection signal NTc is a valid value.

Figure 23:
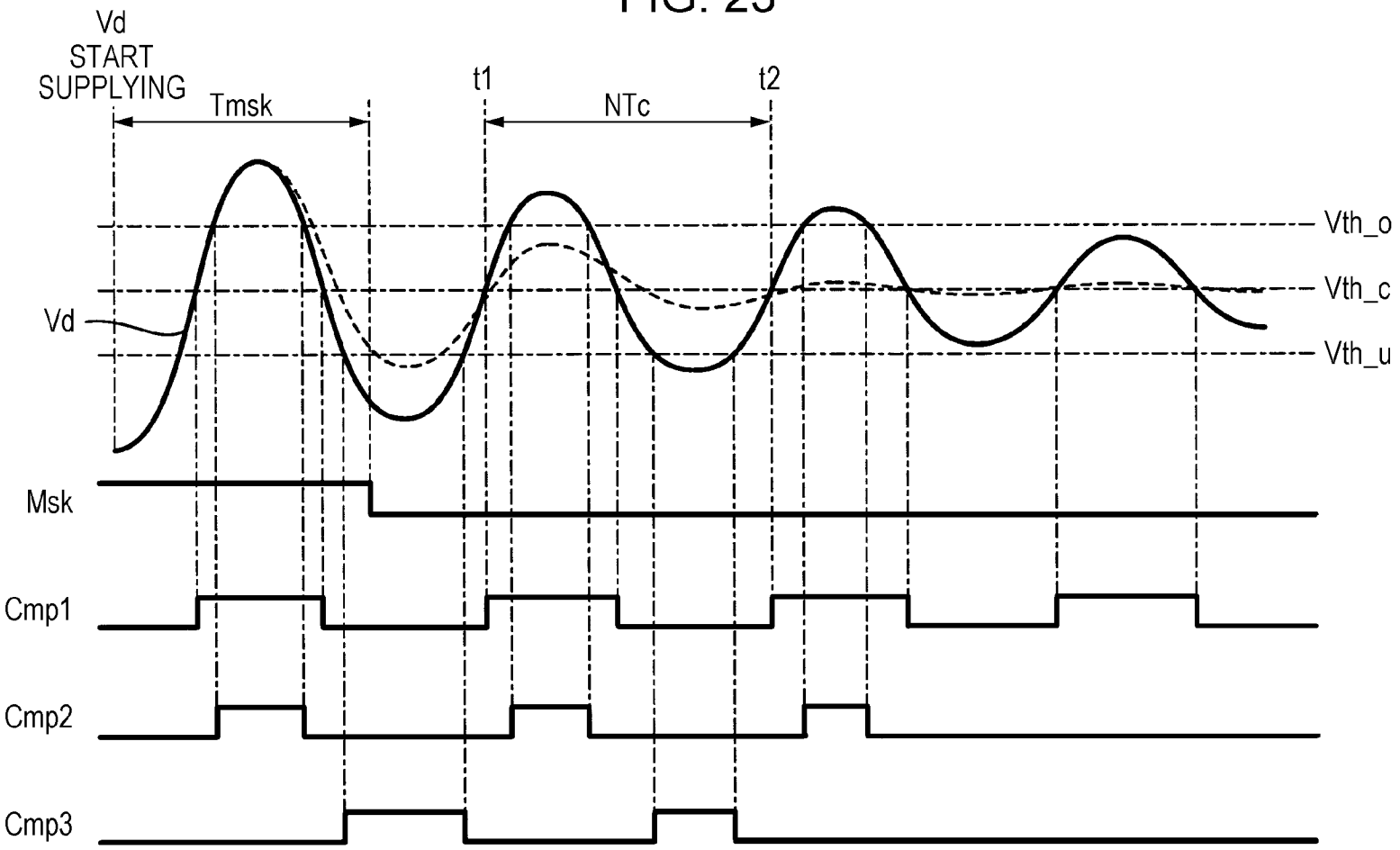
FIG. 23 is a timing chart illustrating an operation of the discharge abnormality detection circuit.

FIG. 23 is a timing chart illustrating the operation of the measuring unit 552.

As illustrated in the drawing, the measuring unit 552 compares the electric potential indicated as the shaped waveform signal Vd and the threshold electric potential Vth_c and generates a comparative signal Cmp1 which becomes a high level in a case where the electric potential indicated as the shaped waveform signal Vd becomes equal to or higher than the threshold electric potential Vth_c and becomes a low level in a case where the electric potential indicated as the shaped waveform signal Vd becomes lower than the threshold electric potential Vth_c.

In addition, the measuring unit 552 compares the electric potential indicated as the shaped waveform signal Vd and the threshold electric potential Vth_o and generates a comparative signal Cmp2 which becomes a high level in a case where the electric potential indicated as the shaped waveform signal Vd becomes equal to or higher than the threshold electric potential Vth_o and becomes the low level in a case where the electric potential indicated as the shaped waveform signal Vd becomes lower than the threshold electric potential Vth_o.

In addition, the measuring unit 552 compares the electric potential indicated as the shaped waveform signal Vd and the threshold electric potential Vth_u and generates a comparative signal Cmp3 which becomes a high level in a case where the electric potential indicated as the shaped waveform signal Vd becomes lower than the threshold electric potential Vth_u and becomes a high level in a case where the electric potential indicated as the shaped waveform signal Vd becomes equal to or higher than the threshold electric potential Vth_u.

The mask signal Msk is a signal which becomes the high level only for a predetermined period Tmsk from a time when the shaped waveform signal Vd is started to be supplied from the waveform shaping unit 551. In the embodiment, among the shaped waveform signals Vd, by generating the detection signal NTc having the shaped waveform signal Vd after the period Tmsk passes as the only target, it is possible to obtain the detection signal NTc in which the accuracy is high and the overlapped noise components are removed immediately after starting the residual vibration.

The measuring unit 552 has a counter (not illustrated). The counter starts counting a clock signal (not illustrated) at the time t1 which is a timing when the electric potential indicated as the shaped waveform signal Vd becomes equal to the threshold electric potential Vth_c for the first time after the mask signal Msk falls to the low level. In other words, the counter starts counting at the time t1 which is an earlier timing among the timings when the comparative signal Cmp1 rises to the high level for the first time or when the comparative signal Cmp1 falls to the low level for the first time after the mask signal Msk falls to the low level.

After starting the counter, the counter finishes counting the clock signal at the time t2 which is a timing when the electric potential indicated as the shaped waveform signal Vd becomes the threshold electric potential Vth_c for the second time, and outputs the obtained counting value as the detection signal NTc. In other words, the counter finishes counting at the time t2 which is an earlier timing among the timings when the comparative signal Cmp1 rises to the high level for the second time or when the comparative signal Cmp1 falls to the low level for the second time after the mask signal Msk falls to the low level.

In such a manner, the measuring unit 552 measures the time length from the time t1 to time t2 as a time length of one cycle of the shaped waveform signal Vd, and thus the measuring unit 552 generates the detection signal NTc.

However, in a case where the amplitude of the shaped waveform signal Vd is small as illustrated as a dashed line in FIG. 23, a probability of the detection signal NTc not being able to be accurately measured becomes high. In addition, in a case where the amplitude of the shaped waveform signal Vd is small, even when the discharge state of the discharging unit 35 is determined as normal only based on a result of the detection signal NTc, there is a possibility of the discharge abnormality being actually generated. For example, in a case where the amplitude of the shaped waveform signal Vd is small, a state where the ink cannot be discharged as the ink is not injected into the cavity 141, or the like, can be considered.

The embodiment determines whether or not the amplitude of the shaped waveform signal Vd has sufficient size to measure the detection signal NTc, and the result of the determination is output as the validity Flag.

Specifically, during the period when the counting is performed by the counter, that is, during the period from the time t1 to the time t2, in a case where the electric potential indicated as the shaped waveform signal Vd exceeds the threshold electric potential Vth_o, and is lower than the threshold electric potential Vth_u, the measuring unit 552 sets a value of the validity Flag to 1 which shows that the detection signal NTc is valid. In other cases, the measuring unit 552 sets the value to 0, and then outputs the validity Flag. More specifically, during the period from the time t1 to the time t2, in a case where the comparative signal Cmp2 falls to the low level again after rising to the high level from the low level, and in a case where the comparative signal Cmp3 falls to the low level again after rising to the high level from the low level, the measuring unit 552 sets the value of the validity Flag to 1. In other cases, the measuring unit 552 sets the value of the validity flag to 0.

In the embodiment, the measuring unit 552 generates the detection signal NTc which shows the time length of one cycle of the shaped waveform signal Vd. In addition, since the measuring unit 552 determines whether or not the shaped waveform signal Vd has a sufficient amplitude to measure the detection signal NTc, it is possible to detect the discharge abnormality more accurately.

Based on the detection signal NTc and the validity Flag, the determination unit 56 determines the discharge state of the ink in the discharging unit 35 and outputs the determination result as the determination result signal Rs.

Figures 24, 25:
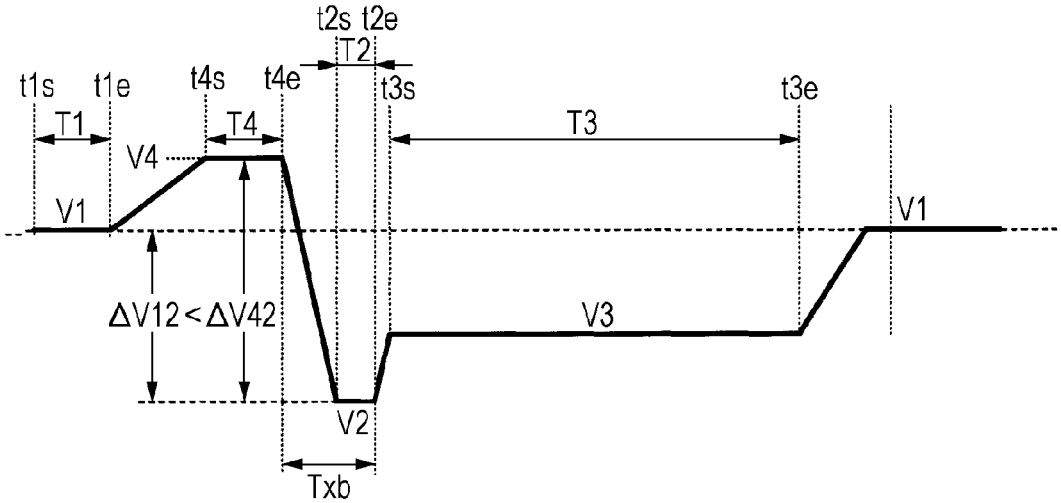
FIG. 24 is a view describing a generation of a determination result signal in the determination unit.
FIG. 25 is a waveform diagram illustrating the waveform of the driving signal for inspection according to a modification example.

FIG. 24 is a view illustrating the content of determination in the determination unit 56. As illustrated in the drawing, the determination unit 56 compares the time length indicated as the detection signal NTc with the time lengths of a threshold value NTx1, a threshold value NTx2 which shows a time length longer than that of the threshold value NTx1, and a threshold value NTx3 which shows a time length yet longer than that of the threshold value NTx2, respectively.

Here, the threshold value NTx1 is a value for illustrating a boundary between the time length of one cycle of the residual vibration in a case where air bubbles are generated inside the cavity 141 and the frequency of the residual vibration is high, and the time length of one cycle of the residual vibration in a case where the discharge state is normal.

In addition, the threshold value NTx2 is a value for illustrating a boundary between the time length of one cycle of the residual vibration in a case where the paper powder adheres in the vicinity of the outlet of the nozzle N and the frequency of the residual vibration is low, and the time length of one cycle of the residual vibration in a case where the discharge state is normal.

In addition, the threshold value NTx3 is a value for illustrating a boundary between the time length of one cycle of the residual vibration in a case where the ink is fixed or thickened in the vicinity of the nozzle N and the frequency of the residual vibration is much lower than that of a case where the paper powder adheres, and the time length of one cycle of the residual vibration in a case where the paper powder adheres in the vicinity of the outlet of the nozzle N.

As illustrated in FIG. 24, in a case where the value of the validity Flag is 1 and satisfies NTx1≤NTc≤NTx2, the determination unit 56 determines that the discharge state of the ink is normal in the discharging unit 35 and sets the value which shows that the discharge state is normal to 1 with respect to the determination result signal Rs.

In a case where the value of the validity Flag is 1 and satisfies NTc<NTx1, the determination unit 56 determines that the discharge abnormality is generated due to air bubbles generated in the cavity 141 and sets the value which shows that discharge abnormality is generated due to the air bubbles to 2 with respect to the determination result signal Rs.

In a case where the value of the validity Flag is 1 and satisfies NTx2<NTc≤NTx3, the determination unit 56 determines that the discharge abnormality is generated due to the paper powder adhered to the vicinity of the outlet of the nozzle N and sets the value which shows that discharge abnormality is generated due to the paper powder to 3 with respect to the determination result signal Rs.

In a case where the value of the validity Flag is 1 and satisfies NTx3<NTc, the determination unit 56 determines that the discharge abnormality is generated due to the thickened ink in the vicinity of the nozzle N and sets the value which shows that discharge abnormality is generated due to the thickened ink to 4 with respect to the determination result signal Rs.

In a case where the value of the validity Flag is 0, the determination unit 56 sets the value which shows that discharge abnormality is generated due to any of the reasons, such as injection failure of the ink or the like, to 5.

As described above, the determination unit 56 determines whether or not the discharge abnormality is generated in the discharging unit 35 and outputs the determination result as the determination result signal Rs. For this reason, in a case where the discharge abnormality is generated, as necessary, the control unit 6 suspends the printing process (strictly speaking, the printing operation period is suspended) and the head unit 30 is moved to the initial position (X=Xini). Then, it is possible to perform an appropriate recovery process according to the reason for the discharge abnormality indicated in the determination result signal Rs.

In addition, the determination of the determination unit 56 can be performed in the control unit 6 (CPU 61). In this case, the discharge abnormality detection circuit DT of the discharge abnormality detection unit 52 may be configured not to have the determination unit 56, and may be configured to output the detection signal NTc generated by the detection unit 55 with respect to the control unit 6.

In the embodiment, in the driving signal Vin for inspection, the level is shifted from the first electric potential V1 to the second electric potential V2, and further, is shifted from the second electric potential V2 to the third electric potential V3 which is the electric potential between the first electric potential V1 and the second electric potential V2. Accordingly, it is possible to apply a large excitation force to the ink during the process of shifting from the first electric potential V1 to the second electric potential V2. Furthermore, as the second electric potential V2 is shifted to the third electric potential V3 and the third electric potential V3 is maintained, it is possible to use the excitation force and control the internal pressure of the cavity 245 so that the ink is not discharged from the nozzle N. Accordingly, without discharging the ink from the nozzle N, it is possible to obtain a large residual vibration and accurately determine the discharge state of the ink.

C. MODIFICATION EXAMPLE

Each of the above-described embodiments can be modified in various manners. Examples of specific modifications will be described hereinafter. Two or more examples randomly selected among the examples below can be appropriately combined in a range which is not contradictory to one another.

Modification Example 1

The driving signal Vin for inspection in the above-described embodiment is subject to having three states including the first electric potential V1, the second electric potential V2, and the third electric potential V3. However, the invention is not limited thereto, and the driving signal Vin may be a signal waveform including four or more electric potentials.

For example, as illustrated in FIG. 25, during the period from the ending time t1e of the first period T1 to the starting time t2s of the second period T2, a fourth period T4 during which a fourth electric potential V4 is maintained may be provided, the first electric potential V1 may be shifted to the fourth electric potential V4 from the time t1e to the time t4s, and the fourth electric potential V4 may be shifted to the second electric potential V2 from the time t4e to the time t2s.

Here, the potential difference ΔV42 between the fourth electric potential V4 and the second electric potential V2 is larger than the potential difference ΔV12 between the first electric potential V1 and the second electric potential V2. Therefore, compared to the embodiment, the driving signal Vin for inspection of Modification Example 1 can excite a larger force to the ink inside the cavity 245. Accordingly, the example is effective when the viscosity of the ink is high.

In addition, when the time from the ending time t4e of the fourth period T4 to the ending time t2e of the second period T2 is set to be Txb, and when the natural vibration cycle of the cavity 245 is set to be Tc, because of a similar reason to the above-described embodiment, it is preferable that the time Txb be Tc/2, and furthermore, it is preferable to satisfy the following expression (3).

$$Tc/2-Tc/4<Txb<Tc/2+Tc/4 \quad (3)$$

In addition, particularly, since the range from Tc/2 to Tc/2+Tc/4 is a range after the pressure is changed from decreasing to increasing, by setting the time Txb in this range, it is further possible to enhance the efficiency.

The third period T3 satisfies the expression (2) similarly to the embodiment, however, it is preferable that the residual vibration do not affect the following unit operation period Tu.

Modification Example 2

In the above-described embodiment and modification example, the ink jet printer is the line printer illustrated in FIG. 3, however, it may be a serial printer. For example, instead of the head unit 30 illustrated in FIG. 3, including the head unit of which the width in the Y-axis direction is narrower than the width of the recording paper P, the ink jet printer may be an ink jet printer in which a main scanning direction of the carriage is the Y-axis direction.

Modification Example 3

The above-described embodiment and modification examples describe the ink jet printer as an example of the liquid discharging apparatus which discharges the ink as the liquid. However, the invention is not limited thereto, and any apparatus may be adopted if the apparatus discharges a liquid. For example, an apparatus which discharges a liquid (including a dispersion, such as a suspension, an emulsion, or the like) including various materials to be described below also may be adopted. In other words, the various materials include a filter material (ink) of a color filter, a luminescent material for forming an EL emitting layer in an organic Electro Luminescence (EL) apparatus, a fluorescent material for forming a phosphor on the electrode in an electron emission device, a fluorescent material for forming a phosphor in a Plasma Display Panel (PDP) apparatus, a phoretic material for forming a phoretic body in an electrophoretic display apparatus, a bank material for forming a bank on a surface of a substrate W, various coating materials, a liquid electrode material for forming an electrode, a particulate material for configuring a spacer for configuring a micro cell gap between two substrates, a liquid metal material for forming a metal wiring, a lens material for forming a micro lens, a resist material, a light diffusion material for forming a light diffusion body, and various experimental liquid materials which are used in a biosensor of a DNA chip, a protein chip, or the like.

In the invention, a liquid receiving substance that is a target to which the liquid is discharged is not limited to a paper sheet, such as recording paper, and may be other media such as a film, a cloth, a non-woven fabric or the like, and a workpiece such as various substrates including a glass substrate, silicon substrate or the like.

The entire disclosure of Japanese Patent Application No. 2013-179899, filed Aug. 30, 2013 is expressly incorporated by reference herein.

What is claimed is:

1. A liquid discharging apparatus comprising:

a nozzle which discharges a liquid;

a pressure chamber which communicates with the nozzle;

a piezoelectric element which is provided in order to discharge the liquid corresponding to the pressure chamber;

a driving signal generation unit which generates a driving signal in order to drive the piezoelectric element; and a residual vibration detection unit which detects a change in an electromotive force of the piezoelectric element according to a residual vibration generated after applying the driving signal in the pressure chamber, wherein the driving signal generation unit generates a driving signal for inspection which is a first electric potential during a first period, is a second electric potential during a second period, is a third electric potential during a third period, is shifted from the first electric potential to the second electric potential, and is shifted from the second electric potential to the third electric potential, and wherein the third electric potential is an electric potential between the first electric potential and the second electric potential.

2. The liquid discharging apparatus according to claim 1, wherein, in the driving signal for inspection, when a time from an end of the first period to an end of the second period is set to Txa, and when a natural vibration cycle of the pressure chamber is set to Tc, $Tc/2-Tc/4<Txa<Tc/2+Tc/4$.

3. The liquid discharging apparatus according to claim 1, wherein, during a period from the end of the first period to a start of the second period, the driving signal generation unit is provided with a fourth period which maintains a fourth electric potential, shifts the driving signal for the inspection from the first electric potential to the fourth electric potential, and shifts the driving signal for the inspection from the fourth electric potential to the second electric potential, and wherein potential difference between the fourth electric potential and the second electric potential is larger than potential difference between the first electric potential and the second electric potential.

4. The liquid discharging apparatus according to claim 3, wherein, in the driving signal for inspection, when a time from an end of the fourth period to the end of the second period is set to Txb, and when the natural vibration cycle of the pressure chamber is set to Tc, $Tc/2-Tc/4<Txb<Tc/2+Tc/4$.

5. The liquid discharging apparatus according to claim 1, wherein the driving signal generation unit generates the driving signal for inspection so that the third period is longer than the second period.

6. The liquid discharging apparatus according to claim 1, wherein the driving signal generation unit generates the driving signal for inspection so that the third period is longer than a natural vibration cycle of the pressure chamber.

7. The liquid discharging apparatus according to claim 1, wherein, when a time from a start of the third period to an end of the third period is set to T3, when a natural vibration cycle of the pressure chamber is set to Tc, and when k is set to a natural number, $k\cdot Tc-Tc/4<T3<k\cdot Tc+Tc/4$.

8. A controlling method for a liquid discharging apparatus including a nozzle which discharges a liquid, a pressure chamber which communicates with the nozzle, and a piezoelectric element which is provided in order to discharge the liquid corresponding to the pressure chamber, the method comprising:

applying a driving signal for inspection to the piezoelectric element;

detecting a change in an electromotive force of the piezoelectric element according to the residual vibration generated after applying the driving signal for inspection in the pressure chamber; and determining a discharge state of the liquid according to the detection result, wherein the driving signal for inspection is the first electric potential during a first period, is a second electric potential during a second period, is a third electric potential during a third period, is shifted from the first electric potential to the second electric potential, and is shifted from the second electric potential to the third electric potential, and wherein the third electric potential is an electric potential between the first electric potential and the second electric potential.

* * * * *